US010274166B2

(12) United States Patent
Li et al.

(10) Patent No.: US 10,274,166 B2
(45) Date of Patent: Apr. 30, 2019

(54) SOLID-STATE LINEAR LIGHTING ARRANGEMENTS INCLUDING LIGHT EMITTING PHOSPHOR

(71) Applicant: Intematix Corporation, Fremont, CA (US)

(72) Inventors: Yi-Qun Li, Danville, CA (US); Haitao Yang, San Jose, CA (US); Hyung-Chul Lee, Fremont, CA (US); Charles Edwards, Pleasanton, CA (US)

(73) Assignee: Intematix Corporation, Fremont, CA (US)

( * ) Notice: Subject to any disclaimer, the term of this patent is extended or adjusted under 35 U.S.C. 154(b) by 0 days.

(21) Appl. No.: 15/653,071

(22) Filed: Jul. 18, 2017

(65) Prior Publication Data

US 2018/0156421 A1 Jun. 7, 2018

Related U.S. Application Data

(63) Continuation of application No. 13/931,669, filed on Jun. 28, 2013, now abandoned, which is a (Continued)

(51) Int. Cl.

| | |
|---|---|
| ***F21K 9/27*** | (2016.01) |
| ***F21K 9/64*** | (2016.01) |
| ***F21V 3/02*** | (2006.01) |
| ***F21V 3/12*** | (2018.01) |
| ***F21V 5/04*** | (2006.01) |
| ***F21V 7/00*** | (2006.01) |
| ***F21V 9/30*** | (2018.01) |
| ***F21K 9/232*** | (2016.01) |
| ***F21V 13/02*** | (2006.01) |
| ***F21V 13/14*** | (2006.01) |
| ***F21Y 103/10*** | (2016.01) |
| ***F21Y 107/30*** | (2016.01) |

(Continued)

(52) U.S. Cl.

CPC ..... *F21V 13/02* (2013.01); *F21K 9/232* (2016.08); *F21K 9/27* (2016.08); *F21K 9/64* (2016.08); *F21V 3/02* (2013.01); *F21V 3/12* (2018.02); *F21V 5/04* (2013.01); *F21V 5/041* (2013.01); *F21V 5/043* (2013.01); *F21V 9/30* (2018.02); *F21V 7/005* (2013.01); *F21V 13/14* (2013.01); *F21Y 2103/10* (2016.08); *F21Y 2107/30* (2016.08); *F21Y 2115/10* (2016.08); *F21Y 2115/30* (2016.08)

(58) Field of Classification Search

None

See application file for complete search history.

(56) References Cited

U.S. PATENT DOCUMENTS

2006/0028837 A1* 2/2006 Mrakovich ..... G02B 6/001 362/602

* cited by examiner

*Primary Examiner* — Anh T Mai
*Assistant Examiner* — Zachary J Snyder
(74) *Attorney, Agent, or Firm* — Vista IP Law Group, LLP

(57) ABSTRACT

A solid-state linear lamp comprises a co-extruded component, the co-extruded component comprising an elongate lens and a layer of photoluminescent material. The elongate lens is for shaping light emitted from the lamp and comprises an elongate interior cavity. The layer of a photoluminescent material is located on an interior wall of the elongate interior cavity. The lamp further comprises an array of solid-state light emitters configured to emit light into the elongate interior cavity.

16 Claims, 37 Drawing Sheets

Related U.S. Application Data continuation-in-part of application No. 11/640,533, filed on Dec. 15, 2006, now abandoned.

(60) Provisional application No. 61/665,843, filed on Jun. 28, 2012, provisional application No. 60/835,601, filed on Aug. 3, 2006.

(51) Int. Cl.
*F21Y 115/10* (2016.01)
*F21Y 115/30* (2016.01)

SOLID-STATE LINEAR LIGHTING ARRANGEMENTS INCLUDING LIGHT EMITTING PHOSPHOR

CROSS REFERENCE TO RELATED APPLICATIONS

This application is a continuation of U.S. application Ser. No. 13/931,669, filed on Jun. 28, 2013, which claims the benefit of U.S. Provisional Application No. 61/665,843, entitled "LINEAR LED LIGHTING ARRANGEMENT INCLUDING LIGHT EMITTING PHOSPHOR", filed on Jun. 28, 2012, and is also a continuation-in-part of U.S. patent application Ser. No. 11/640,533, filed Dec. 15, 2006, entitled "LED Lighting Arrangement Including Light Emitting Phosphor" which claims the benefit of priority to U.S. Provisional Application No. 60/835,601, filed Aug. 3, 2006, entitled "Phosphor Containing Optical Components for LED Illumination Systems," all of which are hereby incorporated by reference in their entireties.

BACKGROUND OF THE INVENTION

Field of the Invention

This invention relates to solid-state linear lighting applications which comprise a light emitting phosphor, photoluminescent material, to generate light of a desired color that is in a different part of the wavelength spectrum from the solid-state light emitter(s). In particular, although not exclusively, the invention concerns LED-based lighting arrangements which generate light in the visible part of the spectrum and in particular, although not exclusively white light. Moreover the invention provides an optical component for such a lighting arrangement and methods of fabricating a lighting arrangement and an optical component.

State of the Art

White light emitting diodes (LEDs) are known in the art and are a relatively recent innovation. It was not until LEDs emitting in the blue/ultraviolet of the electromagnetic spectrum were developed that it became practical to develop white light sources based on LEDs. As is known, white light generating LEDs ("white LEDs") include a phosphor that is a photoluminescent material, which absorbs a portion of the radiation emitted by the LED and re-emits radiation of a different color (wavelength). For example the LED emits blue light in the visible part of the spectrum and the phosphor re-emits yellow light. Alternatively the phosphor can emit a combination of green and red light, green and yellow or yellow and red light. The portion of the visible blue light emitted by the LED which is not absorbed by the phosphor mixes with the yellow light emitted to provide light which appears to the eye as being white. It is predicted that white LEDs could potentially replace incandescent light sources due to their long operating lifetimes, typically many 100,000 of hours, and their high efficiency. Already high brightness LEDs are used in vehicle brake lights and indicators as well as traffic lights and flash lights.

To increase the intensity of light emitted from an LED it is known to include a lens made of a plastics material or glass to focus the light emission and to thereby increase intensity. Referring to FIG. 1 a high brightness white LED 2 is shown. The LED 2 comprises an LED chip 4 which is mounted within a plastic or metal reflection cup 6 and the LED chip is then encapsulated within an encapsulating material, typically an epoxy resin 8. The encapsulation material includes the phosphor material for providing color conversion. Typically the inner surface of the cup 6 is silvered to reflect stray light towards a lens 10 which is mounted on the surface of the encapsulating epoxy resin 8.

It is appreciated that such an arrangement has limitations and the present invention arose in an endeavor to mitigate, at least in part, these limitations. For example for high intensity LEDs having a high intensity output larger than 1 W, the high temperature at the output of the LED combined with its close proximity the phosphor material can give rise to a light characteristic which is temperature dependent and in some cases thermal degradation of the phosphor material can occur. Moreover the uniformity of color of light emitted by such LEDs can be difficult to maintain with the phosphor distributed within the epoxy resin since light passing through different path lengths will encounter and be absorbed by differing amounts of phosphor. Furthermore the fabrication of such LEDs is time consuming due to the encapsulation and subsequent placement of the lens.

SUMMARY OF THE INVENTION

In accordance with an embodiment of the invention, a linear lighting arrangement is provided which includes a linear transparent optical lens that serves to mix and distribute of lights emitted from LED(s) and phosphor. The phosphor layer in a curved shape within an interior cavity of the linear optical lens. The LED(s) on a linear PCB is located remotely from the phosphor layer. In some embodiments, the lens is preferably manufactured with a rough surface for efficient extraction of light. The linear lighting arrangement may be referred to herein by example as a "linear lamp".

In some embodiments, a linear lamp comprises an array of LED chips mounted on a support, e.g. a printed circuit board that fits within inside indentations/slots on the lens, where an inner cavity/chamber is formed in the interior of the lens. The walls of the chamber include a layer of phosphor. The surface of the circuit board may be formed or covered with a reflective material to reflect light from the LED chip away from the circuit board and towards the phosphor. The light emitted by the LED chip is converted by the phosphor into photoluminescent light, and the color quality of the final light emission output of the lamp is based (at least in part) upon the combination of the wavelength of the photoluminescent light emitted by the phosphor with the wavelength of any remaining light from the LED chip that pass through the phosphor. The color of light emitted from the lighting arrangement can be controlled by appropriate selection of the phosphor composition as well as the thickness and/or loading of phosphor within the phosphor layer which will determine the proportion of output light originating from the phosphor. To ensure a uniform output color the phosphor layer is preferably of uniform thickness and has a typical thickness in a range 20 to 500 μm.

The arrangement and shape of the lens may be configured to affect the actual pattern of the emitted light from the lamp. The lens in some embodiments has a semi-circular profile that permits focusing and distribution of the emitted light output from lamp in desired directions, e.g. for a range of coverage substantially corresponding to the radial angles of the lens from a center axis of the lamp. The lens can be made of any suitable material, e.g. a plastics material such as polycarbonates, acrylic, silicone or glass such as silica based glass or any material.

The arrangement and shape of the phosphor may be configured to affect the distribution of the emitted light from the lamp. Some embodiments provide for a conical profile for the phosphor that enhances the amount of light that is distributed from the sides of the lamp. An alternate design is directed to a lamp in which the phosphor has a profile that is more semi-circular in nature, rather than conical, which provides relatively greater distributions of light towards the center of the distribution area. The exact shape of the phosphor and/or the lens can be selected and combined to provide any suitable output pattern and distribution as desired. Another benefit is that the lens also serves to provide a chamber in which light is mixed within highly transparent solid with minimal loss. An example of this occurs when a lamp includes both red and blue LEDs in the chamber, and the chamber allows the light from these LEDs (e.g., the red light) to be uniformly distributed inside the lens.

In some embodiments, the chamber in the lens provides a cavity within the lamp, which has a volume that is large enough for insertion of the array of LEDs within the cavity. This permits the LED to be located, wholly or partially, within the interior of the lens and/or phosphor. The approach of implementing a cavity/chamber within the lens makes for very simple assembly and improved efficiency due to avoiding losses from an exterior mixing chamber.

Some embodiments implement the optical material of the lens with a clear or transparent property provides the benefit of creating a linear optic/linear lens. Alternatively, the lens can be configured to operate as a light pipe that provides collimation at the light source so the light travels inside the pipe for an extended distance without exiting the sides. The optical component can be configured with appropriately curved sides to provide collimation functionality. In an alternative embodiment the lens is not configured to extend along the entire length of the reflector. Instead, the lens generally forms a curved or dome-like shape that only partially fills the interior volume formed by the reflector. A co-extrusion process can be used to manufacture the structure of the phosphor layer, lens, and reflector. The concept of co-extruding the phosphor and lens as a single component is considered inventive in its own right.

In some embodiments, further operating efficiencies for the lamp are provided by including an optical medium within the chamber, e.g., a solid optical medium. The optical medium within the chamber comprises a material possessing an index of refraction that more closely matches the index of refraction for the phosphor, the LEDs, and/or any type of encapsulating material that may exist on top of the LEDs. The optical medium may be selected of a material, e.g. silicone, to generally fall within or match the index of refraction for materials typically used for the phosphor, the LEDs, and/or any encapsulating material that be used to surround the LEDs. In some embodiments, the lamp structure comprises a multi-layered "sandwich" structure in which a specific shape of the phosphor layer is embedded between a front lens and solid fill inside the chamber. This structure can be manufactured by, for example, co-extrusion of all three layers.

Some embodiments of a linear lamp include an elongate lens having an integrally formed chamber that runs the length of the lens, where the chamber is shaped to provide a desired light distribution pattern. A linear array of LEDs is located on a circuit board, and a reflective material is provided which include apertures for the LEDs. The circuit board is mounted onto a heat sink. The assembly comprising the heat sink, circuit board, and reflective material is attached to the lens using a pair of endplates to be set at indented end portions of the lens. In embodiments where the linear lamp is intended to be direct replacements for standard fluorescent lamps, end caps are provided which include appropriate connectors such as a G5 or G13 bipin connectors to fit into standard fluorescent lamp fixtures. External reflectors may also be used in conjunction with the lamp to direct output light into desired directions.

The angle of coverage for the lens is configurable to adjust the illumination pattern of the lamp. Increasing the angle of coverage to 360 degrees would result in a lamp having a full 360 degrees of illumination. The bottom portion of the lens is configured such that the lens provides a semi-circular profile having and illumination angle, e.g., at a radial angle at greater than or less than 180 degrees relative to a central axis of the lamp. The angle of the bottom portion of the lens can also be adjusted to adjust the illumination pattern of the lamp, which is tilted in either an outwards direction or an inwards direction.

A light diffusing layer can be provided in some embodiments to improve the visual appearance of the lighting device in an OFF state to an observer. The light diffusing layer includes particles of a light diffractive material that can substantially reduce the passage of external excitation light that would otherwise cause the wavelength conversion component to re-emit light of a wavelength having a yellowish/orange color. The particles of a light diffractive material in the light diffusing layer are selected, for example, to have a size range that increases its probability of scattering blue light, which means that less of the external blue light passes through the light diffusing layer to excite the wavelength conversion layer. The light diffractive particle size can be selected such that the particles will scatter blue light relatively more (e.g. at least twice as much) as they will scatter light generated by the phosphor material. Preferably, to enhance the white appearance of the lighting device in an OFF state, the light diffractive material within the light diffusing layer is a "nano-particle" having an average particle size of less than about 150 nm. For light sources that emit lights having other colors, the nano-particle may correspond to other average sizes. For example, the light diffractive material within the light diffusing layer for an UV light source may have an average particle size of less than about 100 nm. Embodiments of the present invention can be used to reduce the amount of phosphor materials that is required to manufacture an LED lighting product, thereby reducing the cost of manufacturing such products given the relatively costly nature of the phosphor materials. In particular, the addition of a light diffusing layer composed of particles of a light diffractive material can substantially reduce the quantity of phosphor material required to generate a selected color of emitted light. Different approaches can be used to introduce light scattering materials into an LED lamp, which can substantially reduce the quantity of phosphor material required to generate a selected color of emitted light. In addition, the light diffusing layer can be used in combination with additional scattering (or reflective/diffractive) particles in the wavelength conversion component to further reduce the amount of phosphor material that is required to generate a selected color of emitted light. One possible approach is in which the light scattering material is included within a separate layer. Another possible approach is in which the light scattering material is included within the layer containing the phosphor. Yet another possible approach is in which the light scattering material is introduced into the lens. Any combination of the above may also be implemented. For example, the light scattering material can be introduced into both the layer of phosphor and the lens. In addition, the light scattering material can be included within both a separate layer and the layer of phosphor. Moreover, the light scattering material can be included within each of the separate layer, the layer of phosphor, and the lens.

Alternative approaches can be taken to improve the off-state white appearance of the lamp. For example, texturing can be incorporated into the exterior surface of the lamp to improve the off-state white appearance of the lamp, e.g. in the exterior surface of the lens. Yet another possible approach is to implement a thin white layer directly after the yellow phosphor layer and before the clear linear optic. This three layer structure would be white appearance in the off-state but the primary optic would still be clear (not diffused/cloudy). This approach has the benefit of preserving the light distribution pattern of the linear lens optics while still providing a white appearance.

The approach of using an interior cavity as a "mixing chamber" can be applied to non-linear lamps as well. In some embodiments, an LED lighting arrangement is provided where the lens comprises a solid semi-spherical shape, and the LED chip is mounted within the chamber of the lighting arrangement such that it is wholly contained within the interior of the profile of the phosphor. However, the lens can be fabricated to provide any suitable shape as desired. For example, an alternate LED lighting arrangement in accordance with an embodiment of the invention is where the lens comprises a solid ovoid shape.

With regard to linear lamp embodiments, any suitable manufacturing process may be employed to manufacture the lamp assembly. For example, a printing process can be employed where ink is printed using screen printing directly onto the lens surface. Other printing techniques can be used to print and/or coat the phosphor, such using roller coaters to coat the phosphor ink onto the lens. Spray coating is another technique that may be used to coat the phosphor onto the lens. Lamination can also be performed to manufacture the linear lamp. In this approach, a separate sheet of phosphor material is manufactured, e.g. with or without a clear carrier layer. The sheet of phosphor is then laminated onto the light lens/pipe structure. A co-extrusion process can be performed to manufacture the linear lamp arrangement. Two extruders can be used to feed into a single tool to create both the layer of phosphor and the materials of the lens, where the two layers are simultaneously created and manufactured together in this approach. If the chamber in the lens includes a solid optical medium, then a co-extrusion approach can be used to manufacture the three layers with three extruders.

In some embodiments, a multi-layered optic component is provided which integrally includes a phosphor portion, a lens, and a reflector portion. A triple-extrusion process can be utilized to manufacture the multi-layered optic component, where three extruders are used to feed into a single tool to create the layer of phosphor, the materials of the lens, and the material of the reflector. Three extruders are used to feed into a single tool to create the three separate layers of materials, including phosphor, the materials of the lens, and the materials of the reflector. The three layers are simultaneously created and manufactured together in this approach. This approach can be used with a wide variety of source materials, e.g. PC-Polycarbonate, PMMA-Poly(methyl methacrylate), and PET-Polyethylene Terephthalate, including most or all thermoform plastics. This triple-extrusion process can generally use pellets identical or similar to pellets used for injection molding materials. If the chamber in the lens includes a solid optical medium, then a quadruple-extrusion approach can be used to manufacture the multiple layers with four extruders.

In some embodiments, the circuit board having the array of LEDs is mounted to, and in thermal communication with, a support body. The reflector is formed having a lower flange portion that extends away from the central portion of the multi-layered optic component. The flange portion is configured to slot within a channel in support body In some embodiments, a co-extrusion process is utilized that manufactures the multi-layered optic component having the array of LEDs, where the LEDs 22 are attached to a structure that is fed into the co-extrusion equipment, such that the multi-layered optic component is affixed to the circuit board having the LEDs as it is being formed.

The inner chamber of the lamp may be filled with an optical medium. The optical medium within the chamber comprises a material, e.g., a solid material, possessing an index of refraction that more closely matches the index of refraction for the phosphor, the LEDs, and/or any type of encapsulating material that may exist on top of the LEDs. The optical medium may be selected of any suitable material, e.g. silicone, to generally fall within or match the index of refraction for materials typically used for the phosphor, the LEDs, and/or any encapsulating material that be used to surround the LEDs. If the chamber in the lens includes a solid optical medium, then a co-extrusion approach can be used to manufacture the multi-layered optic component to also include the optical medium, e.g., by adding an extruder that for the material of the optical medium.

A light diffusing/scattering material can be used in conjunction with the multi-layered optic component. The light diffusing/scattering material is useful to reduce the quantity of phosphor material that is required to generate a selected color of emitted light. The light diffusing/scattering material is also useful to improve the off-state white appearance of the lamp. The light diffusing/scattering material may be included into any of the layers of the multi-layered optic. For example, the light diffusing/scattering material can be incorporated into the layer containing the phosphor, added to the lens, included as an entirely separate layer, or any combination of the above.

In any of the disclosed embodiments, the combination of the solid optical medium and the phosphor can be replaced by a layer of material that entirely fills the volume surrounding the LEDs, but which also includes the phosphor integrally within that layer of material. This provides a hybrid remote-phosphor/non-remote-phosphor approach whereby the phosphor is located in the layer of material that fills the interior cavity, but some of the phosphor is located in close proximity to the LEDs (in the inner portion of the material adjacent to the LEDs), but much of the phosphor is actually quite distant to the LEDs (in the outer portion of the material away from the LEDs). This approach therefore provides much of the advantages of remote-phosphor designs, while also maximizing light conversion efficiencies (due to elimination of mismatches in indices of refraction from eliminating air interfaces). Manufacturing may also be cheaper and easier, since the extrusion processes and apparatuses only need to extrude the single layer of materials, rather than an extruder for the phosphor material and a separate extruder for the optical medium material.

Some embodiments comprise a reflector having high side walls. The side walls are useful to focus the light emitted form lamp into a desired direction.

According to some embodiments, one or more linear lighting arrangements are placed inside of an envelope to form a replacement for a standard incandescent light bulb. The lamp may include standard electrical connectors (e.g., standard Edison-type connectors) that allow lamp to be used in conventional lighting devices. The linear lighting arrangements are vertically oriented, extending axially within the lamp. Internally, the LEDs within the linear lighting arrangements are oriented radially from the central axis of lamp. This configuration provides a good overall emission pattern from lamp over a wide range of emission angles, with the exact dimensions (e.g., length, width) of the linear lighting arrangements selected to provide a desired emission profile. The envelope may be configured in any suitable shape. In some embodiments, envelope comprises a standard light-bulb shape. This permits the lamp to be used in any application/location that could otherwise be implemented with a standard incandescent light bulb. The envelope may include or be used in conjunction with a diffuser. In some embodiments, scattering particles are provided at the envelope, either as an additional layer of material or directly incorporated within the material of envelope.

Inline testing may be employed using any of the above approaches to control and minimize variations in the final manufactured product. With a co-extrusion system, one possible approach to perform in-line testing is to mount a colorimeter or spectrometer that actively measures the product color while it was being extruded. This measurement tool would generally be mounted inline after the cooling bath and dryer but prior to cutting. The color measurement provides real-time feedback to the extrusion system which adjusts layer thickness by varying the relative pressures of the two extrusion screws. The phosphor layer is manufactured to be either thicker or thinner to tune the color of the product in real-time while the extrusion is taking place. This allows one to have single bin accuracy while being able to perform quality checks in real-time during the extrusion process. Similar inline testing could be used with printing and coating methods.

In some embodiments, the length $L_1$ for the exterior surface of the lens exceeds the length $L_2$ of the surface of the phosphor portion. The length $L_2$ in some approaches is at least two times $L_1$.

An optical component may comprise a cylindrical body of axial length l and radius r having a hemispherical end and a planar end which is mountable to an LED package, where the phosphor is provided on the cylindrical and hemispherical surfaces of the component. In some embodiments, the aspect ratio is 3:1 (although other ratios may be employed in certain embodiments).

According to some embodiments of the invention, SQE loss is significantly eliminated or reduced by implementing some or all of the following factors into a lamp design: (i) remote phosphor; (ii) a coupling optic; and (iii) phosphor wavelength conversion layer with an aspect ratio greater than 1:1.

Further details of aspects, objects, and advantages of the invention are described below in the detailed description, drawings, and claims. Both the foregoing general description and the following detailed description are exemplary and explanatory, and are not intended to be limiting as to the scope of the invention.

DETAILED DESCRIPTION OF EMBODIMENTS OF THE INVENTION

In order that the present invention is better understood, embodiments of the invention will now be described by way of example only with reference to the accompanying drawings.

Figure 1:
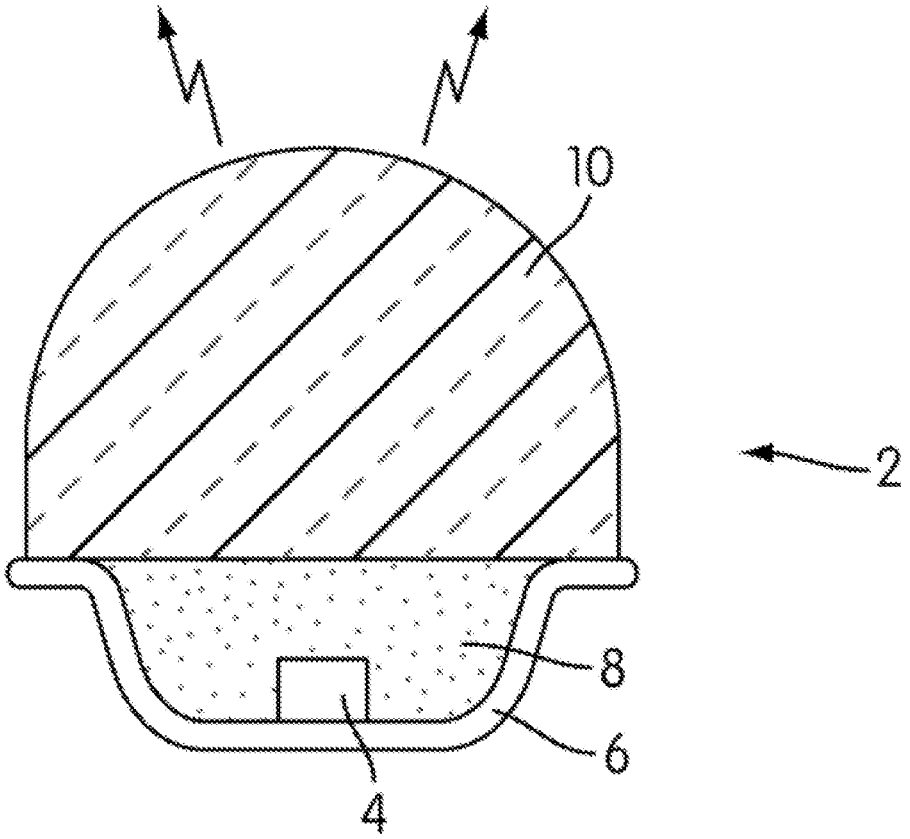
PRIOR ART FIG. 1
FIG. 1 is a schematic representation of a known white LED as already described.
Figure 2:
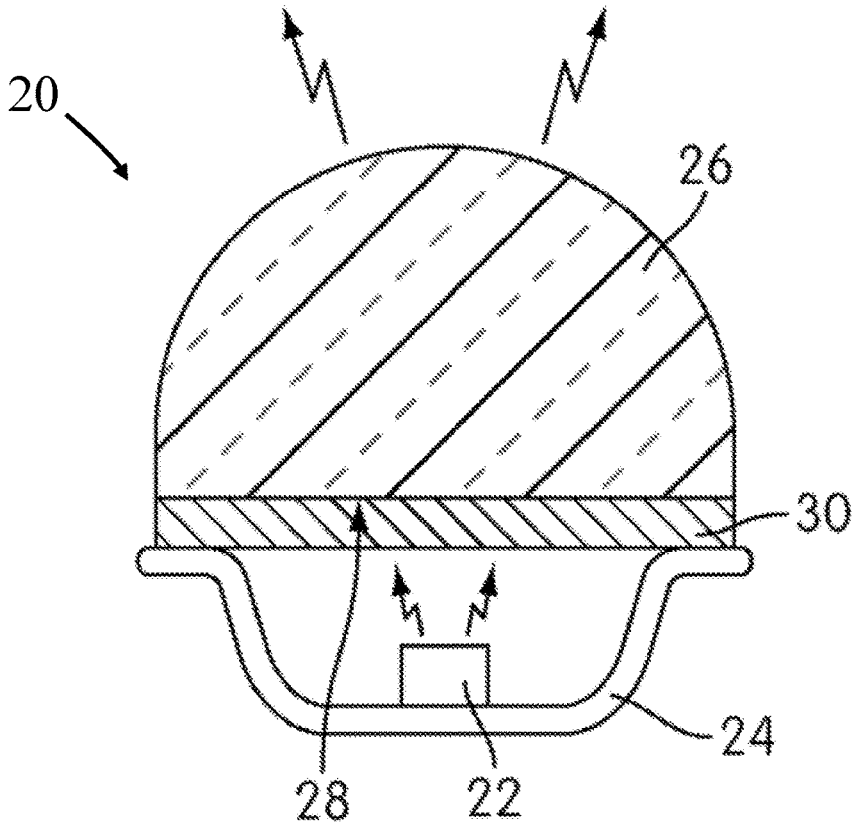
FIGS. 2 to 7 are schematic representations of LED lighting arrangements.

Referring to FIG. 2 there is shown a LED lighting arrangement 20 for generating light of a selected color for example white light. The lighting arrangement 20 comprises a LED chip 22, preferably a Gallium Nitride chip, which is operable to produce light, radiation, preferably of wavelength in a range 300 to 500 nm. The LED chip 22 is mounted inside a stainless steel enclosure or reflection cup 24 which has metallic silver deposited on its inner surface to reflect light towards the output of the lighting arrangement. A convex lens 26 is provided to focus light output from the arrangement. In the illustrated example, the lens 26 is substantially hemispherical in form. The lens 26 can be made of a plastics material such as polycarbonates, acrylic, silicone or glass such as silica based glass or any material substantially transparent to the wavelengths of light generated by the LED chip 22.

In FIG. 2 the lens 26 has a planar, substantially flat, surface 28 onto which there is provided a layer of phosphor 30 before the lens is mounted to the enclosure 22. The phosphor 30 can comprise any photoluminescent material such as a nitride and/or sulfate phosphor materials, oxynitrides and oxy-sulfate phosphors, garnet materials (YAG) or a quantum dot material. The phosphor which is typically in the form of a powder is mixed with an adhesive material such as epoxy or a silicone resin, or a transparent polymer material and the mixture is then applied to the surface of the lens to provide the phosphor layer 30. The mixture can be applied by painting, dropping or spraying or other deposition techniques which will be readily apparent to those skilled in the art. Moreover the phosphor mixture preferably further includes a light diffusing material such as titanium oxide, silica or alumina to ensure a more uniform light output.

The color of light emitted from the lighting arrangement can be controlled by appropriate selection of the phosphor composition as well as the thickness of the phosphor layer and/or weight loading of phosphor which will determine the proportion of output light originating from the phosphor. To ensure a uniform output color the phosphor layer is preferably of uniform thickness and has a typical thickness in a range 20 to 500 μm.

An advantage of such lighting arrangements is that no phosphor need be incorporated within the encapsulation materials in the LED package. Moreover the color of the light output by the arrangement can be readily changed by providing a different lens having an appropriate phosphor layer. This enables large scale production of a common laser package. Moreover such a lens provides direct color conversion in an LED lighting arrangement.

Figure 3:
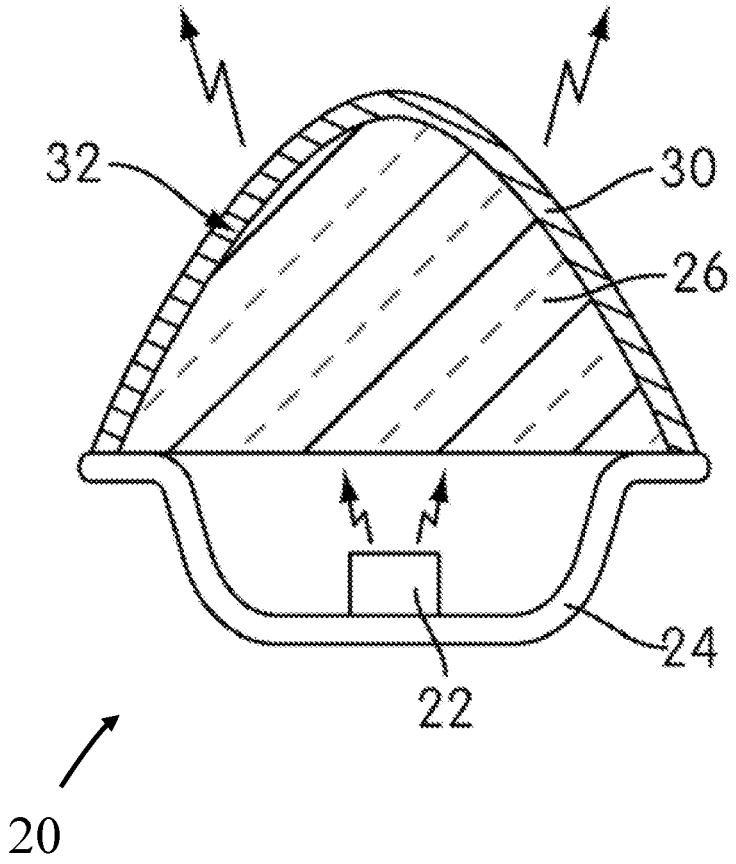

Referring to FIG. 3 there is shown a further LED lighting arrangement 20 in which the phosphor 30 is provided as a layer on the outer convex surface 32 of the lens 26. In this embodiment the lens 26 is dome shaped in form.

Figure 4:
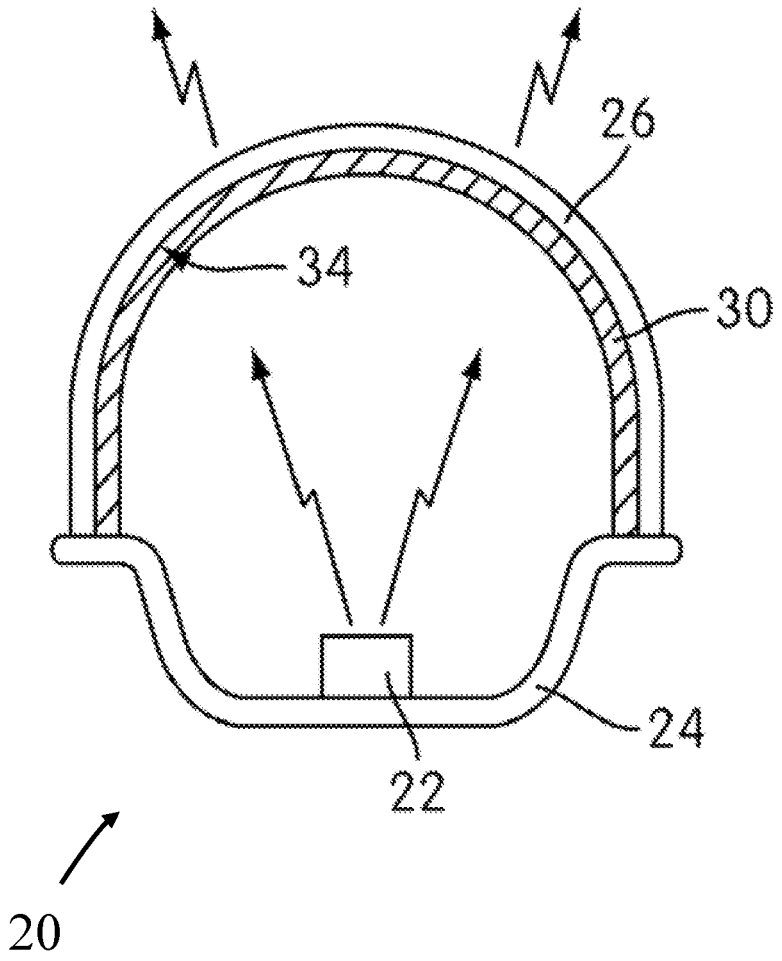

FIG. 4 shows an LED lighting arrangement 20 in which the lens 26 comprises a substantially hemispherical shell and the phosphor 30 is provided on the inner surface 34 of the lens 26. An advantage of providing the phosphor on the inner surface is that the lens 26 then provides environmental protection for the LED and phosphor. Alternatively the phosphor can be applied as a layer of the outer surface of the lens 26 (not shown).

Figure 7:
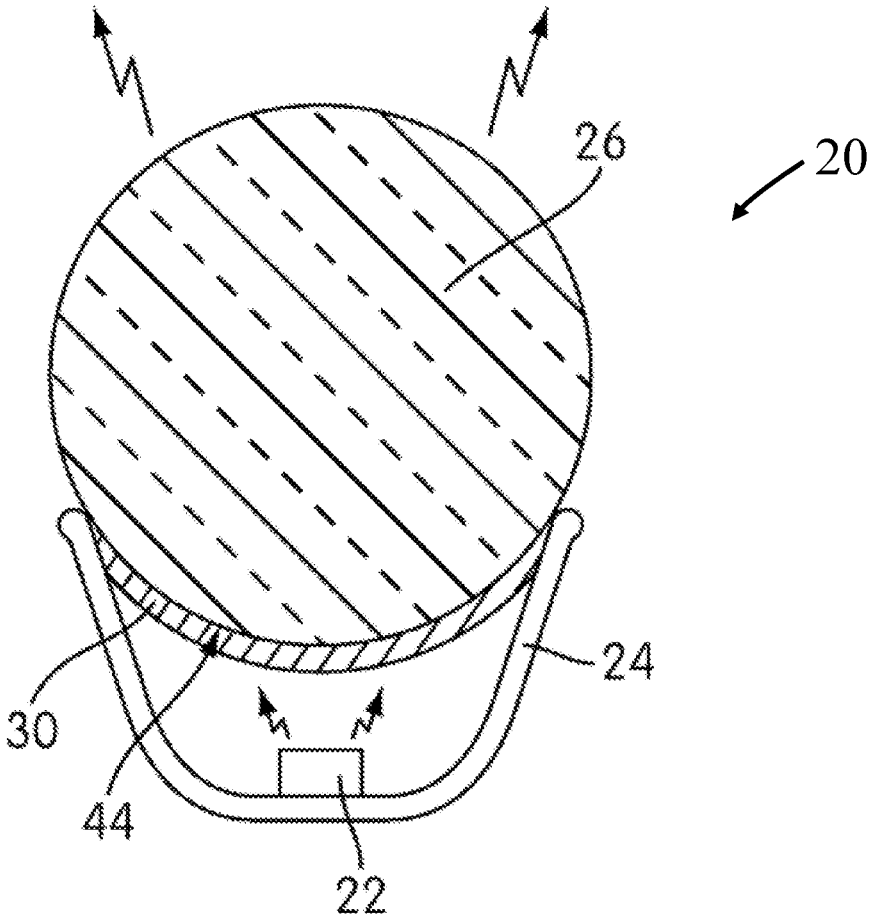

FIG. 7 shows an LED lighting arrangement 20 in which the optical component comprise a solid substantially spherical lens 26 and the phosphor is provided on at least a part of the spherical surface 44. In a preferred arrangement, as illustrated, the phosphor is applied to only a portion of the surface, which surface is then mounted within the volume defined by the enclosure. By mounting the lens 26 in this way this provides environmental protection of the phosphor 30.

Figure 5:
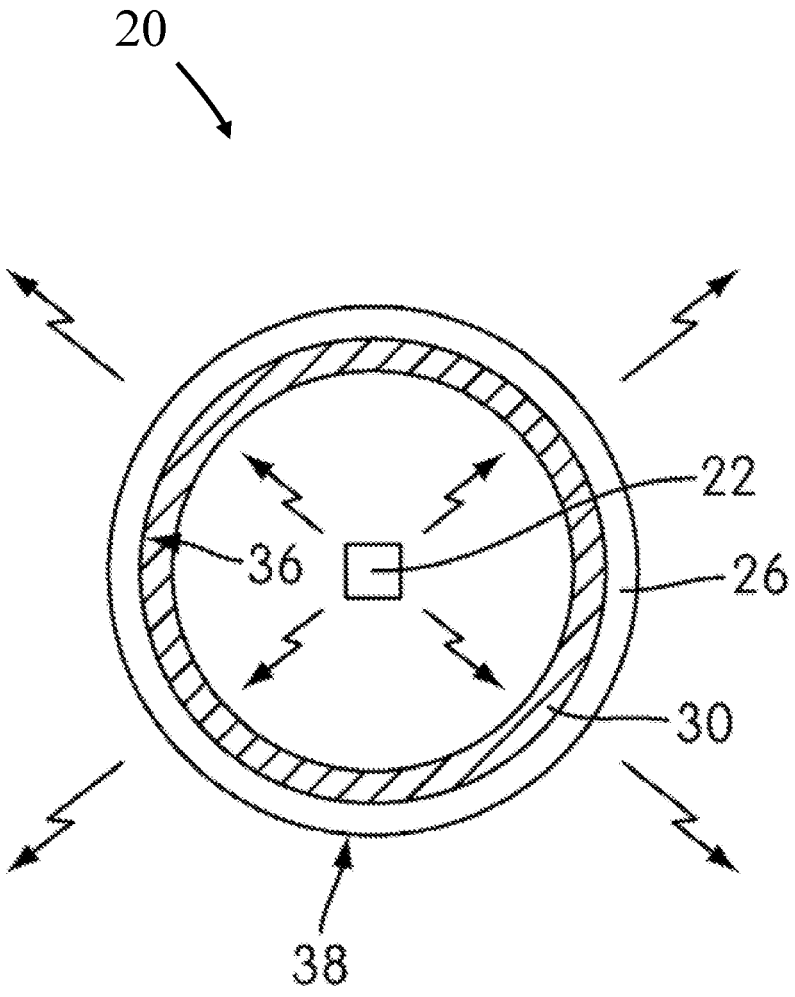

FIG. 5 illustrates an LED lighting arrangement 20 in which the lens 26, optical component, comprises a substantially spherical shell and the phosphor 30 is deposited as a layer on at least a part of the inner 36 or outer spherical 38 surfaces and the LED chip 22 is mounted within the spherical shell. To ensure uniform emission of radiation a plurality of LED chips are advantageously incorporated in which the chip are oriented such that they each emit light in differing directions. Such a form is preferred as a light source for replacing existing incandescent light sources (light bulbs).

Figure 6:
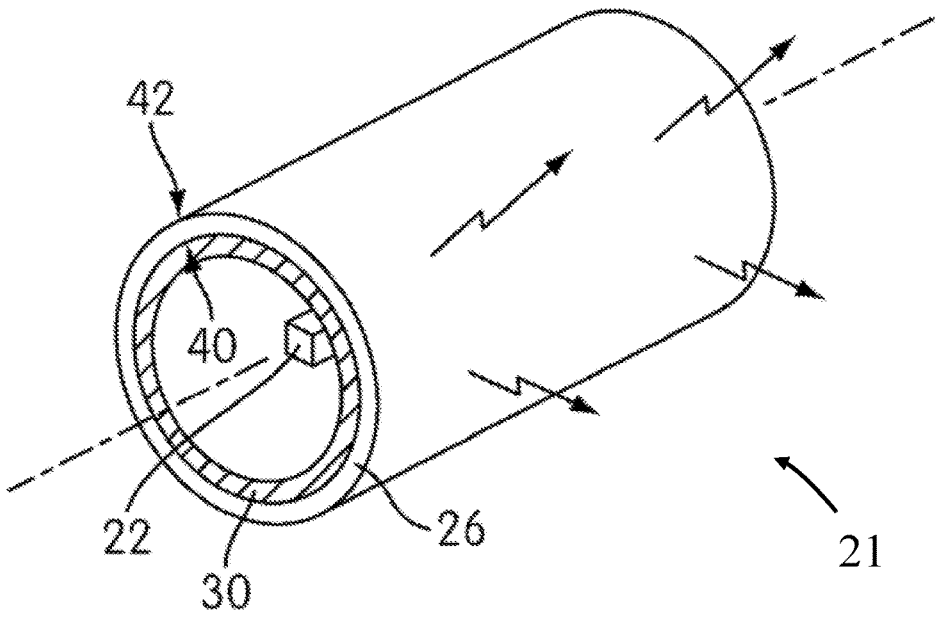

Referring to FIG. 6 there is shown a further LED lighting arrangement 20 in which the optical component 26 comprises a hollow cylindrical form and the phosphor is applied to the inner 40 or outer 42 curved surfaces. In such an arrangement the laser chip preferably comprises a linear array of laser chips that are arranged along the axis of the cylinder. Alternatively the lens 26 can comprise a solid cylinder (not shown).

The embodiment of FIG. 6 generally depicts an example of a linear lighting arrangement/linear lamp 21, which is a lighting apparatus typically having a long tubular profile. These lamps are common in many office or workspace environments, and many commercial and institutional buildings will routinely incorporate lighting fixtures and ceiling recesses/troughs in ceilings to fit standard size linear lamps (such as standard tubular T5, T8, and T12 lamps).

Linear lamps are normally implemented with fluorescent tube technology, encompassing gas discharge lamps that use electricity to excite mercury vapors. However, there are many disadvantages with conventional fluorescent-based lamps. For example, the mercury within the fluorescent lamp is considered poisonous, and breakage of the fluorescent lamp, particularly in ducts or air passages, may require expensive cleanup efforts to remove the mercury (as recommended by the Environmental Protection Agency). Moreover, fluorescent lamps can be quite costly to manufacture, due in part to the requirement of using a ballast to regulate the current in such lamps. In addition, fluorescent lamps have fairly high defects rates and relatively low operating lives.

In contrast, LED-based linear lamps overcome these problems associated with fluorescent lamps. Unlike fluorescent lamps, LED-based linear lamps do not require any mercury. LED-based lamps are able to generate higher lumens per wattage as compared to fluorescent lamps, while having lower defects rates and higher operating life expectancies.

The approach shown in FIG. 6 provides an arrangement in which light generated by the linear lamp is emitted in all directions. The layer of phosphor 30 and the lens/optical component 26 entirely surround the linear array of LEDs 22. The light produced by the lamp is therefore emitted over an entire 360 degrees of direction from the center axis of the lamp.

Figure 8:
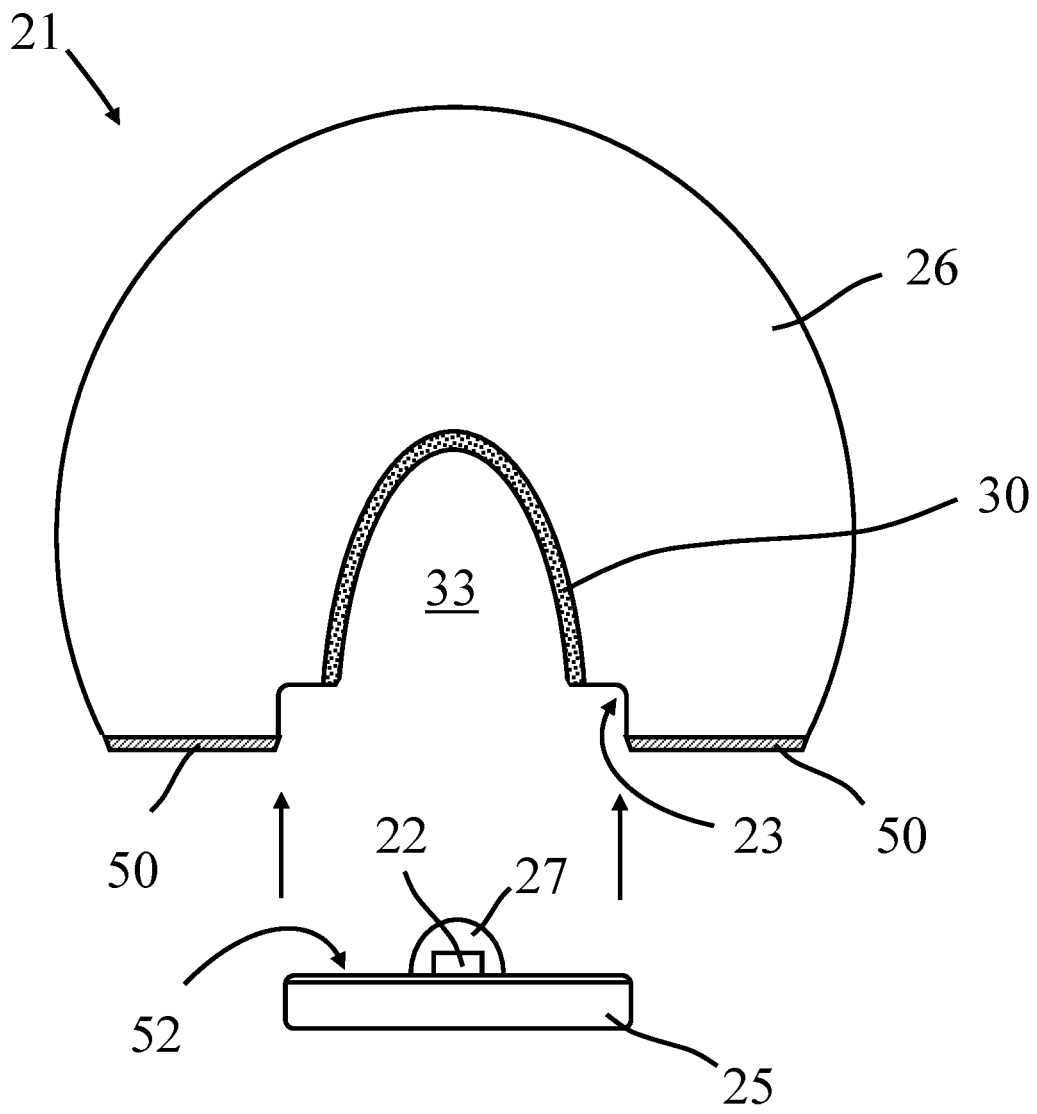
FIG. 8 is an end view of an LED linear lamp lighting arrangement in accordance with an embodiment of the invention.

FIG. 8 illustrates a LED-based linear lamp 21 in accordance with an embodiment of the invention, in which light is emitted in selected directions from the linear lamp. The array of LED chips 22 are mounted on a support, e.g. a printed circuit board 25, that fits within inside indentations 23 on lens 26. An inner cavity/chamber 33 is formed in the interior of the lens 26. The walls of the chamber 33 include a layer of phosphor 30. The LED chip 22 in some embodiments comprises a Gallium Nitride chip which is operable to produce light, radiation, preferably of wavelength in a range 300 to 500 nm. The surface of the circuit board 25 may be formed or covered with a reflective material 52 to reflect light from the LED chip 22 away from the circuit board 25 and towards the phosphor 30.

Each of the LEDs in the array of LED chips 22 may be covered or otherwise encapsulated with a light extracting cover 27. The light extracting cover 27 reduces excessive mismatches between the index of refraction of the LEDs 22 and the index of refraction of the air within the interior chamber 33. Any mismatch in the indices of refraction can cause a significant portion of the LED light to be lost from the total LED light output. By including light extracting cover 27, this helps to reduce excessive mismatches in the indices of refraction, facilitating an increase the overall light conversion efficiency of lamp 21.

The light emitted by the LED chip 22 is converted by the phosphor 30 into photoluminescent light. The color quality of the final light emission output of the lamp is based (at least in part) upon the combination of the wavelength of the photoluminescent light emitted by the phosphor 30 with the wavelength of any remaining light from the LED chip 22 that pass through the phosphor 30. The color of light emitted from the lighting arrangement can be controlled by appropriate selection of the phosphor composition as well as the thickness and/or loading density of phosphor within the phosphor layer which will determine the proportion of output light originating from the phosphor. To ensure a uniform output color the phosphor layer is preferably of uniform thickness and has a typical thickness in a range 20 to 500 μm.

The actual pattern of the emitted light from the lamp 21 is affected by the arrangement of the lens 26. The lens 26 in the current embodiment has a semi-circular profile that permits focusing and distribution of the emitted light output from lamp 21 in desired directions, e.g. for a range of coverage substantially corresponding to the radial angles of the lens 26 from a center axis of the lamp. The lens 26 can be made of any suitable material, e.g. a plastics material such as polycarbonates or glass such as silica based glass or any material.

Figure 13:
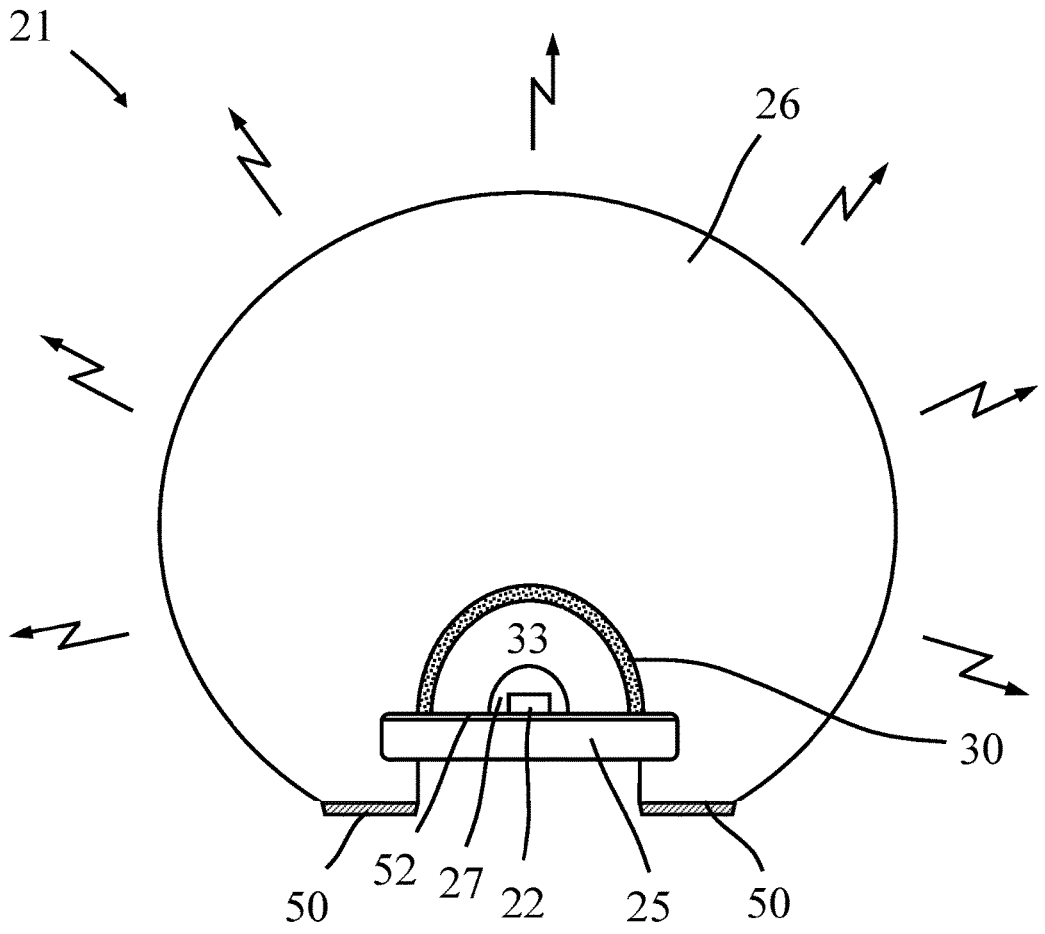
FIG. 13 is an end view of an LED linear lamp lighting arrangement in accordance with an alternate embodiment of the invention.

The distribution of light from the lamp 21 is also affected by the shape of the phosphor 30 in chamber 33. The lamp 21 shown in FIG. 8 has a conical profile for the phosphor 30 that enhances the amount of light that is distributed from the sides of the lamp 21. FIG. 13 illustrates an alternate design in which the phosphor 30 has a profile that is more semi-circular in nature, rather than conical. This approach provides relatively greater distributions of light towards the center of the distribution area. The exact shape of the phosphor 30 and/or the lens 26 can be selected and combined to provide any suitable output pattern and distribution as desired.

The chamber 33 provides a cavity (also referred to herein as a "mixing chamber") within the lamp 21, which has a volume that is large enough for insertion of the LED 22 within the cavity. This permits the LED 22 to be located, wholly or partially, within the interior of the lens 26 and/or phosphor 30.

In the approach of FIG. 8, the indentation/slot 23 is incorporated into the outer profile of the lens 26 to accommodate direct placement of the PCB 25 or Chip-On-Board (COB) array. In the approach of FIG. 14, a slot formed within the lens 26 to permit the PCB 25 to slide and support into the slot. The PCB or COB surface has a reflective layer or coating 52 placed on it to reflect LED-emitted light towards the phosphor 30. The bottom surface of the lens 26 may also be covered with a reflective material 50. The approach of implementing a cavity/chamber 33 within the lens 26 makes for very simple assembly and improved efficiency due to avoiding losses from an exterior mixing chamber.

A benefit provided by this arrangement is that the chamber provides for mixing of light within highly transparent solid with minimal loss. An example of this occurs when a lamp includes both red and blue LEDs in the chamber, and the chamber allows the light from these LEDs (e.g., the red light) to be uniformly distributed inside the lens. There are various reasons for the advantages provided by the internal mixing chamber. For example, one reason is because the arrangement of the internal mixing chamber provides for cross-wall emissions of light. Even though reflectors are still provided on the "floor" of the lamp, much of the light that moves through the mixing chamber will cross from one wall of the phosphor to another wall without needing to reflect from the reflectors, improving the efficiency of the lamp for its light production. Another benefit provided by the arrangement is that it removes the point source impact of having individual LEDSs in the lamp. Each LED is a point source of light (e.g., blue or red light), but because the LEDs are within the chamber that has its walls covered with phosphor, the light emitted by the phosphor will visibly obscure the point source effects of the LEDs. Yet another advantage is the directionality provided by the current arrangement. Since most fluorescent replacement lamps will be inserted into ceiling or wall fixtures, it is likely that the emitted light will be provided in a desired direction, e.g., away from the ceiling or wall. The present embodiment of using the lens and internal chamber configuration enhances the directionality of the emitted light in the desired directions. Another benefit provided by embodiments of the invention is that the amount of phosphor needed to manufacture the lamp can be minimized for a given size of the lamp. Even though the external dimensions of the lamp may be quite large due to the size of the lens, the smaller surface area of the internal chamber means that a much smaller amount of phosphor is actually required for the lamp. A further benefit of the small internal chamber is that it reduces the apparent size of the phosphor component when viewing the lamp in an off-state.

Figure 27A:
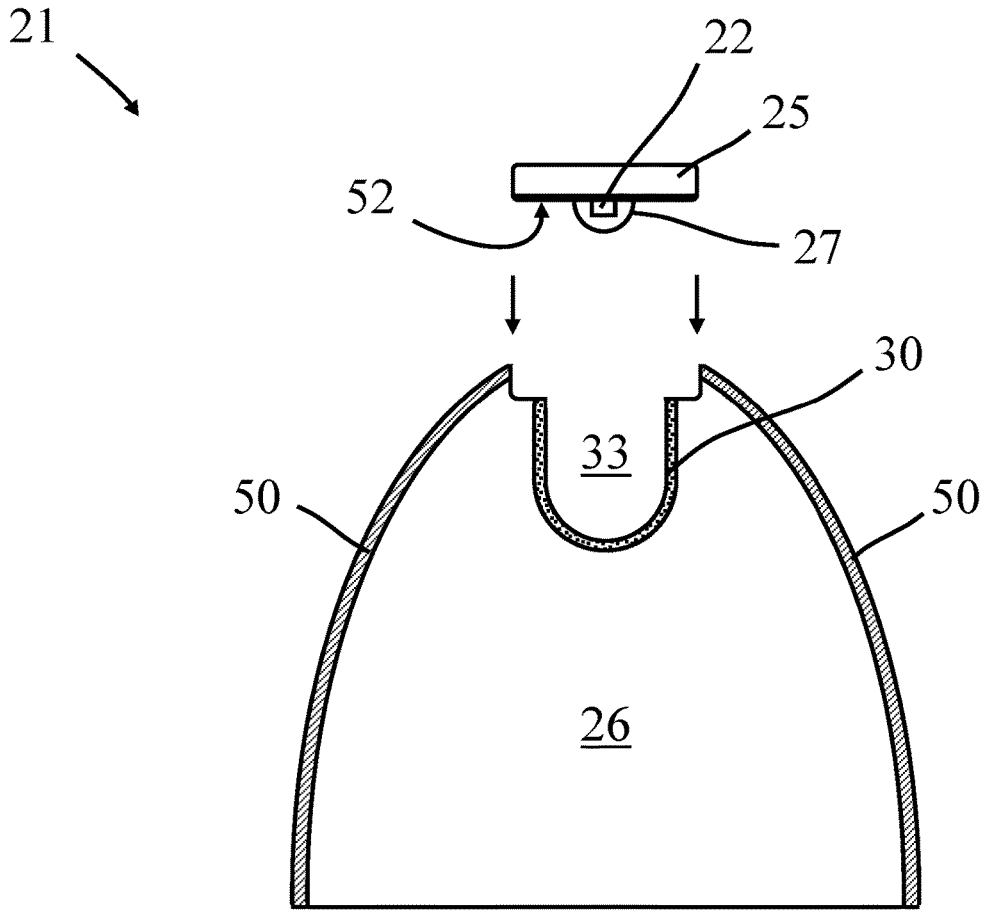
FIG. 27A is a schematic representation of a LED linear lamp lighting arrangement in which the lens provides collimation functionality.

Leaving the optical material of the lens 26 with a clear or transparent property also provides the benefit of creating a linear optic/linear lens. Alternatively, the lens can be configured to operate as a light pipe that provides collimation at the light source so the light travels inside the pipe for an extended distance without exiting the sides. For example, FIG. 27A shows a lamp where the optical component 26 is configured with appropriately curved sides to provide collimation functionality. In this arrangement, the light emitted from the phosphor 30 that impact the walls of the lens 26 at certain angles will reflect away from those walls in a downwards direction, e.g., based at least in part upon the light pipe effects of the lens 26. This result is achievable without the need to include reflective material 50 on the walls of the lens 26, although inclusion of reflective material 50 will improve the efficiency at which light is emitted in the downwards direction.

Figure 27B:
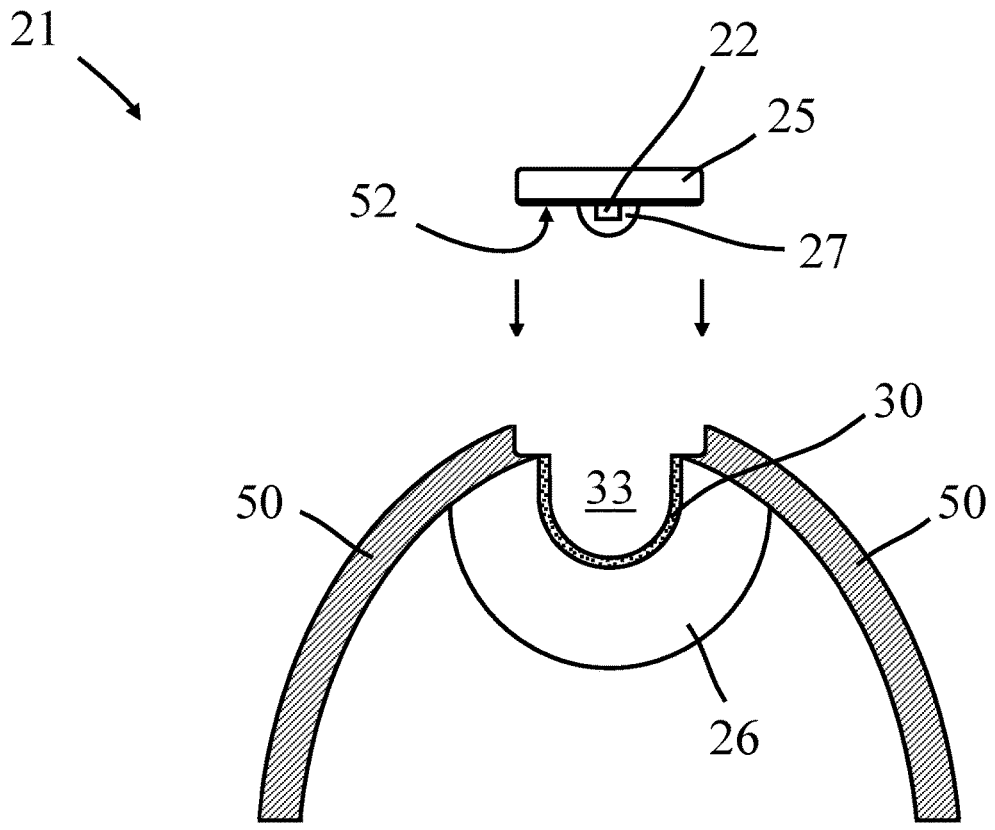
FIG. 27B is a schematic representation of an alternative LED linear lamp lighting arrangement.

FIG. 27B shows an alternative embodiment of a lamp 21 where the lens 26 is not configured to extend along the entire length of the reflector 50. Instead, the lens 26 generally forms a curved or dome-like shape that only partially fills the interior volume formed by the reflector 50. Appropriate configuration of the lens 26 and reflector 50 permit this approach to form a direct lamp replacement having any desired light emission characteristics. In both the approaches of FIGS. 27A and 27B, a co-extrusion process can be used to manufacture the structure of the phosphor layer, lens, and reflector.

In the embodiment of FIG. 8, the light is generally unstructured without a collimator. However the current embodiment does create a linear lens optic with the clear material that is coupled to a smaller linear light source (the phosphor layer). The combined system allows one to accurately control the light distribution pattern with minimal losses because there is no air interface between the remote phosphor layer and optics. The cross section in the figures shows a light source and single optic coupled together into a single unit. It is possible to configure specific linear beam patterns by designing the shape of the linear lens relative to the light source. In effect, the lens 26 can be used to shape the emitted properties of the light that is generated by the lamp, e.g., by focusing the emitted light from the lamp.

In some embodiments, further operating efficiencies for the lamp are provided by including an optical medium within the chamber 33. The optical medium within the chamber 33 comprises a material, e.g., a solid material, possessing an index of refraction that more closely matches the index of refraction for the phosphor 30, the LEDs 22, and/or any type of encapsulating material that may exist on top of the LEDs 22. One reason or using the optical medium is to eliminate air interfaces that exist between the LEDs 22 and the phosphor 30. The problem addressed by this embodiment is that there is a mismatch between the index of refraction of the material of the phosphor 30 and the index of refraction of the air within the interior volume 33 of the lamp 21. This mismatch in the indices of refraction for the interfaces between air and the lamp components may cause a significant portion of the light to be lost in the form of heat generation. As a result, lesser amounts of light and excessive amounts of heat are generated for a given quantity of input power. By filling the chamber 33 with an optical medium 56, this approach permits light to be emitted to, within, and/or through the interior volume of the lamp without having to incur losses caused by excessive mismatches in the indices of refraction for an air interface. The optical medium 56 may be selected of a material, e.g. silicone, to generally fall within or match the index of refraction for materials typically used for the phosphor 30, the LEDs 22, and/or any encapsulating material that be used to surround the LEDs 22. Further details regarding an exemplary approach to implement the optical medium are described in U.S. Provisional Application Ser. No. 61/657,702, filed on Jun. 8, 2012, entitled "Solid-State Lamps With Improved Emission Efficiency And Photoluminescence Wavelength Conversion Components Therefor", which is hereby incorporated by reference in its entirety.

Figure 9:
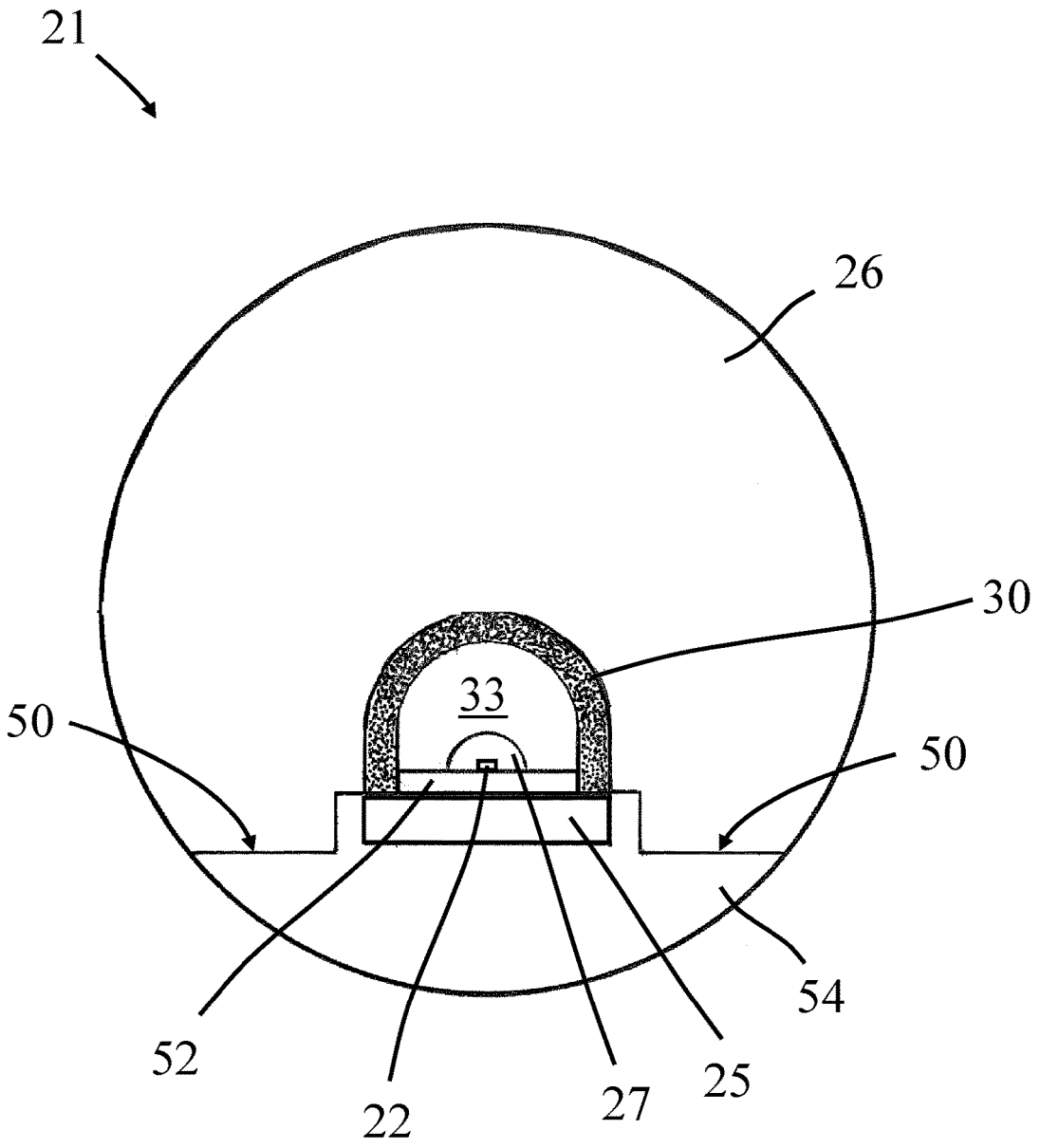
FIGS. 9-12 are schematic representations of an LED linear lamp lighting arrangement in accordance with an embodiment of the invention.
Figure 10:
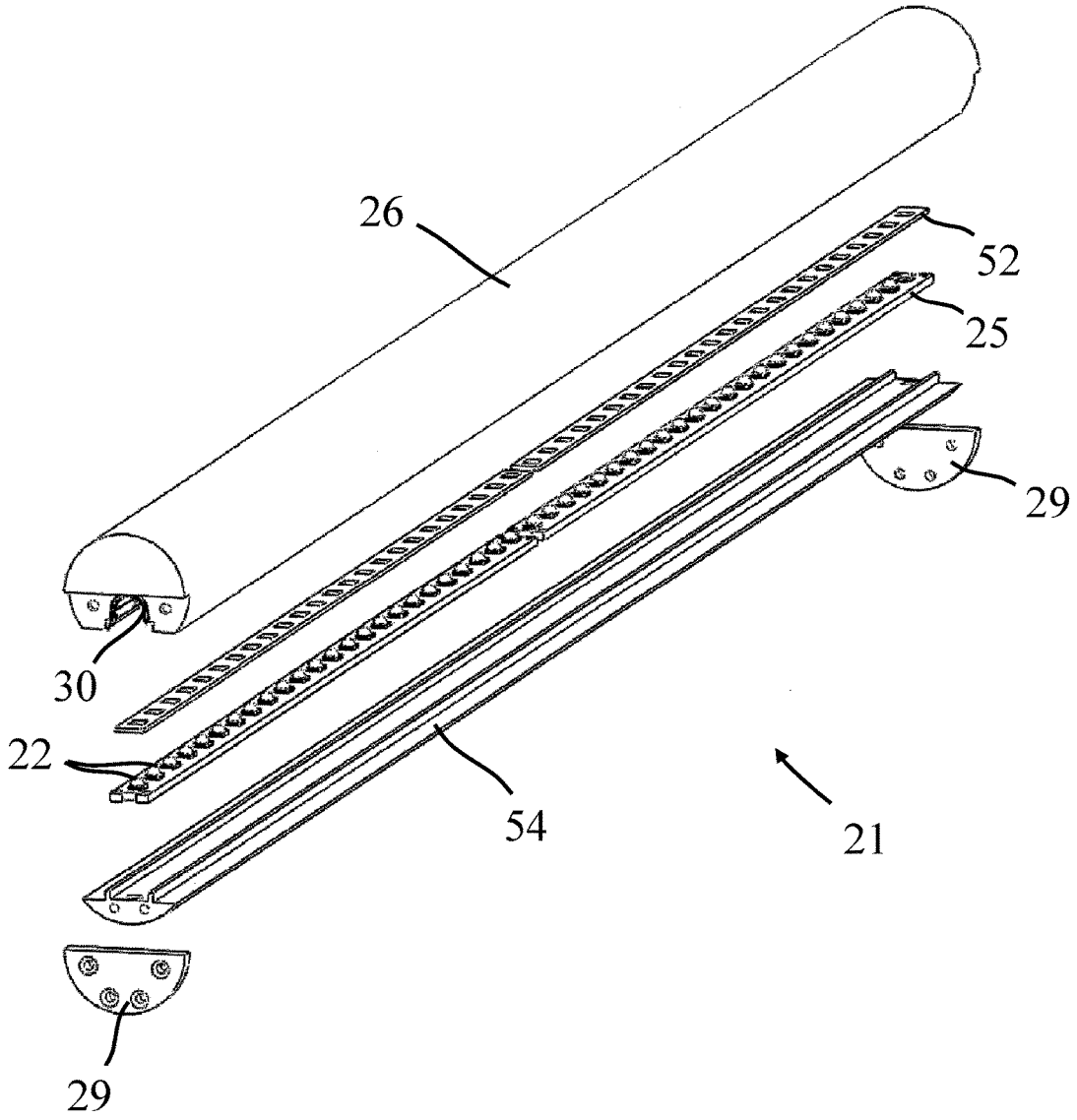
Figure 11:
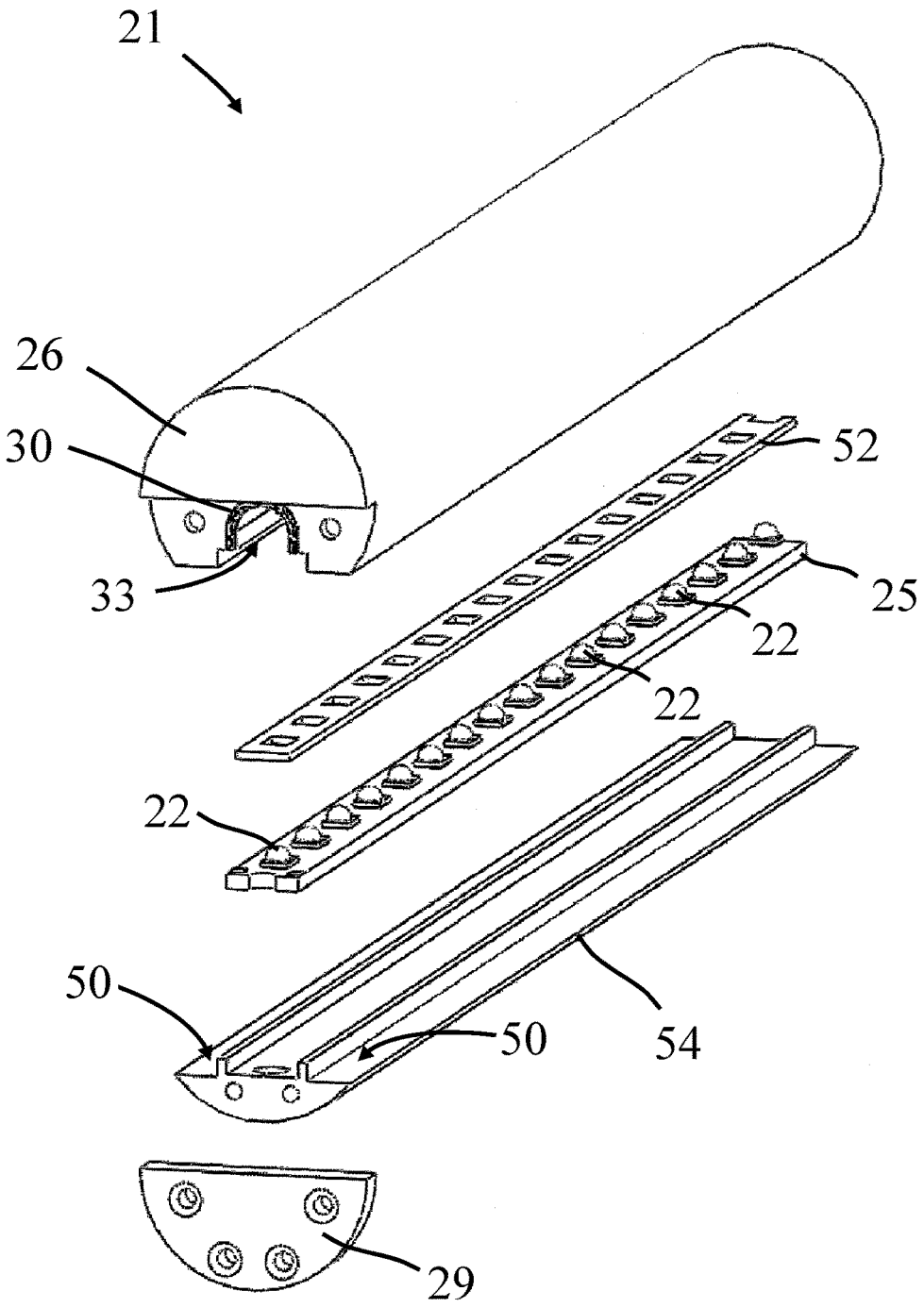
Figure 12:
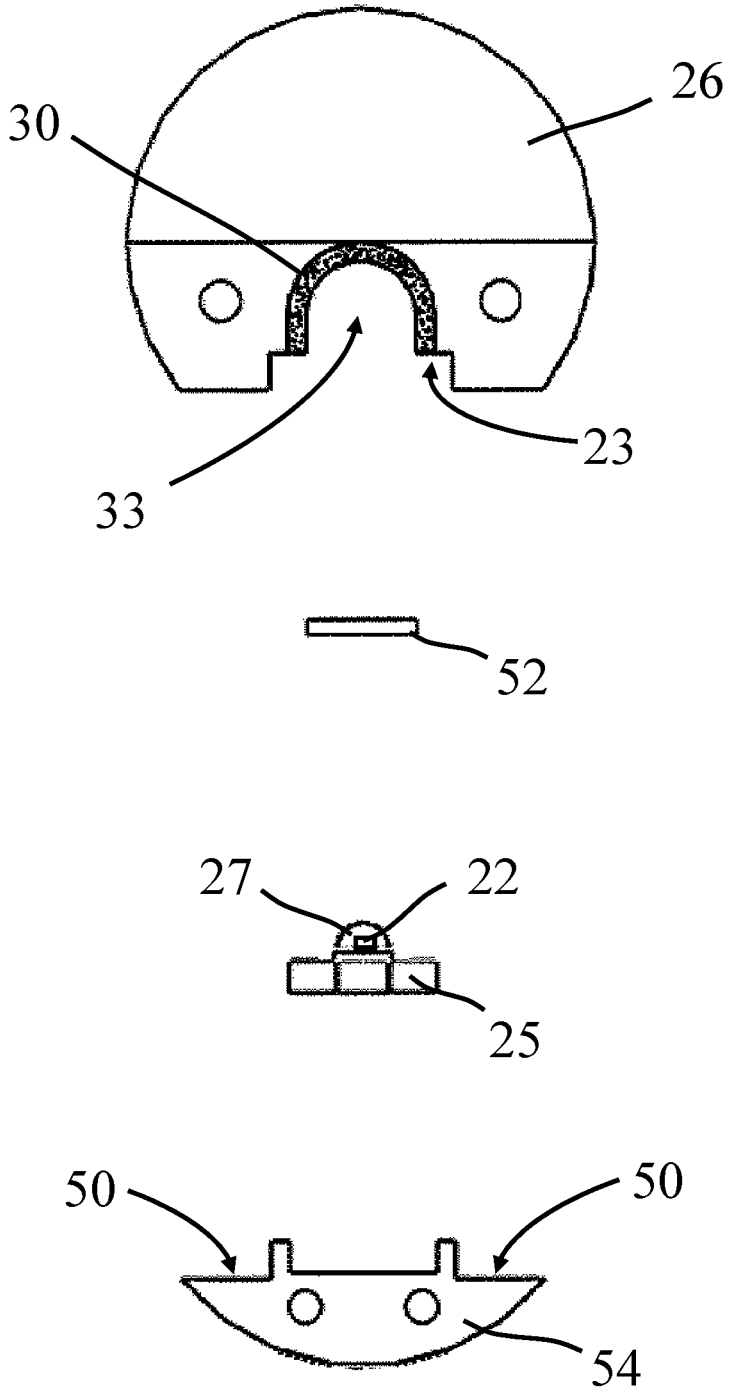

FIGS. 9, 10, 11, and 12 provide illustrations of the components of a linear lamp 21 according to particular embodiments of the invention. FIG. 9 is an end view and FIG. 12 is an exploded end view of the linear lamp 21. FIG. 10 is an exploded perspective view of the lamp 21, which is further magnified in FIG. 11. The linear lamp 21 includes an elongate lens 26 having an integrally formed chamber 33 that runs the length of the lens 26. The chamber 33 is shaped to provide a desired light distribution pattern. In this current example of the linear lamp 21, the cavity 33 is shown with a dome-shaped profile. A layer of phosphor 30 is placed within the chamber 33.

A linear array of LEDs 22 is located on a circuit board 25. Any suitable approach can be taken to implement the array of LEDs 22. For example, the LED array may be implemented using a chip-on-board (COB) configuration. A reflective material 52 (e.g., reflective tape or paper) is provided which include apertures for the LEDs 22. The circuit board 25 is mounted onto a heat sink 54. The assembly comprising the heat sink 54, circuit board 25, and reflective material 52 is attached to the lens 26 using a pair of endplates 29 to be set at the indented end portion of the lens 26. The endplate 29 includes a set of four screw holes (not shown in FIG. 9). The top two screw holes are for insertion of screws to openings in the lens 26. The bottom two screws are for insertion of screws to openings in the heat sink 54.

In embodiments where the linear lamp 21 is intended to be direct replacements for standard fluorescent lamps such as t5, T8 or T12 fluorescent tubes, end caps (not shown) are provided which include appropriate connectors such as a G5 or G13 bi-pin connectors to fit into standard fluorescent lamp fixtures. External reflectors (not shown) may also be used in conjunction with lamp 21 to direct output light from the lamp 21 into desired directions. The direction of orientation for lamp 21 would be adjusted as appropriate. For example, the lamp would normally be directed in a downwards direction (e.g. with the lens 26 facing downwards below a reflector) when installed into a ceiling fixture.

Figure 14A:
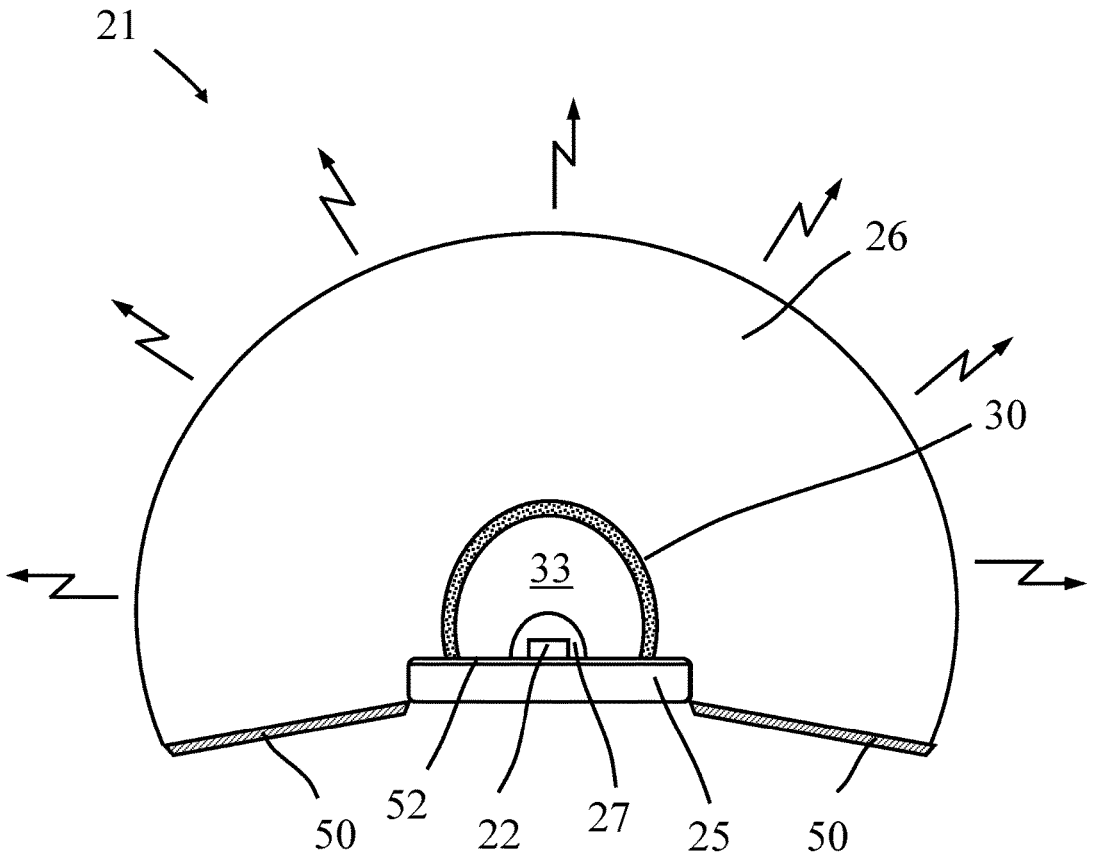
FIGS. 14A and 14B are an end views of additional embodiments of LED linear lamp lighting arrangements.
Figure 14B:
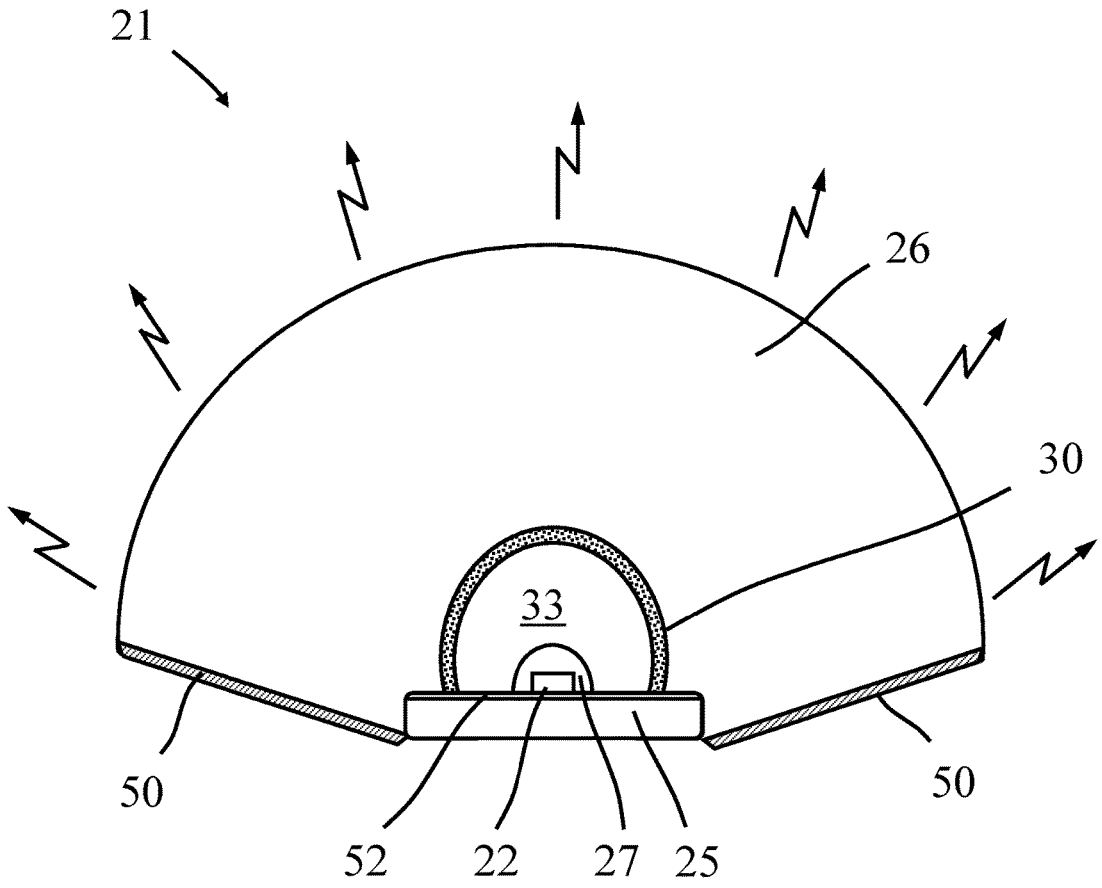

The bottom portion of the lens 26 is configurable to adjust the illumination pattern of the lamp 21, e.g., by adjusting the radial angle of coverage for the lens 26 as measured from a central axis of the lamp. If the profile of the lens extends over a full 360 degrees from a central axis, this would result in a lamp having 360 degrees of illumination, e.g., as shown in the lamp of FIG. 6. The angle of the bottom portion of the lens can also be adjusted to adjust the illumination pattern of the lamp. FIG. 14A illustrates the end view of an embodiment of the invention in which the bottom portion of the lens 26 is configured such that the lens 26 provides a semi-circular profile having a radial angle at slightly greater than 180 degrees relative to a central axis of the lamp 21, e.g., where the portions 50 are tilted in an outward direction to improve the spread of light emitted by the lamp. An alternate embodiment can be configured such that the bottom portion of the lens 26 is tilted in an inwards direction. FIG. 14B illustrates the end view of an embodiment of the invention in which the bottom portion of the lens 26 is configured such that the lens 26 provides a semi-circular profile having a radial angle at slightly less than 180 degrees relative to a central axis of the lamp 21, e.g., where the portions 50 are tilted in an inward direction to improve the concentration of light emitted by the lamp in a selected direction.

One problem associated with LED lighting device that is addressed by embodiments of the invention is the non-white color appearance of the device in an OFF state. During an ON state, the LED chip or die generates blue light and some portion of the blue light is thereafter absorbed by the phosphor(s) to re-emit yellow light (or a combination of green and red light, green and yellow light, green and orange or yellow and red light). The portion of the blue light generated by the LED that is not absorbed by the phosphor combined with the light emitted by the phosphor provides light which appears to the human eye as being nearly white in color. However, in an OFF state, the LED chip or die does not generate any blue light. Instead, light that is produced by the remote phosphor lighting apparatus is based at least in part upon external light (e.g. sunlight or room lights) that excites the phosphor material in the wavelength conversion component, and which therefore generates a yellowish, yellow-orange or orange color in the photoluminescence light. Since the LED chip or die is not generating any blue light, this means that there will not be any residual blue light to combine with the yellow/orange light from the photoluminescence light of the wavelength conversion component (e.g. phosphor 30) to generate white appearing light. As a result, the lighting device will appear to be yellowish, yellow-orange or orange in color. This may be undesirable to the potential purchaser or customer that is seeking a white-appearing light.

Figure 15:
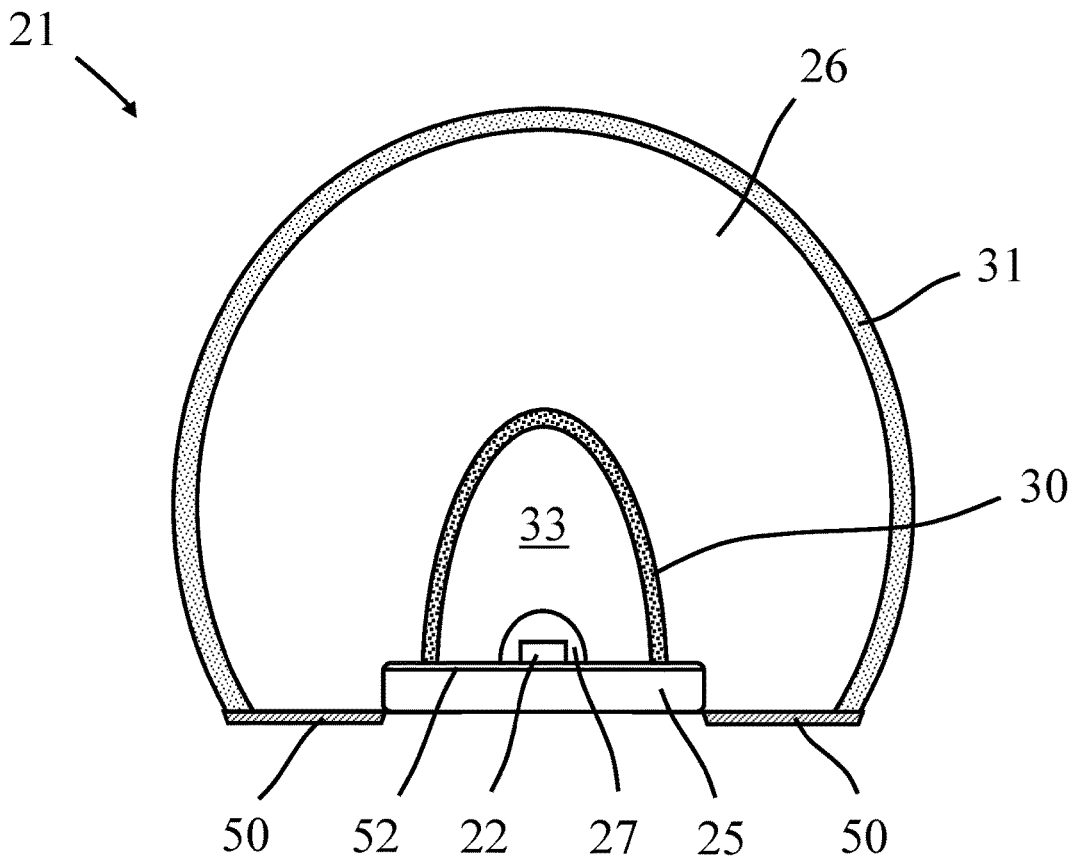
FIGS. 15-17 are schematic representations of LED linear lamp lighting arrangement with scattering particles.

According to the embodiment of FIG. 15, a light diffusing layer 31 provides the benefit of addressing this problem by improving the visual appearance of the device in an OFF state to an observer. In part, this is because the light diffusing layer 31 includes particles of a light diffractive material that can substantially reduce the passage of external excitation light that would otherwise cause the wavelength conversion component to re-emit light of a wavelength having a yellowish/orange color. The particles of a light diffractive material in the light diffusing layer 31 are selected, for example, to have a size range that increases its probability of scattering blue light, which means that less of the external blue light passes through the light diffusing layer to excite the wavelength conversion layer. Therefore, the remote phosphor lighting apparatus will have more of a white appearance in an OFF state since the wavelength conversion component is emitting less yellow/red light.

The light diffractive particle size can be selected such that the particles will scatter blue light relatively more (e.g. at least twice as much) as they will scatter light generated by the phosphor material. Such a light diffusing layer ensures that during an OFF state, a higher proportion of the external blue light received by the device will be scattered and directed by the light diffractive material away from the wavelength conversion layer, decreasing the probability of externally originated photons interacting with a phosphor material particle and minimizing the generation of the yellowish/orange photoluminescent light. However, during an ON state, phosphor generated light caused by excitation light from the LED light source can nevertheless pass through the diffusing layer with a lower probability of being scattered. Preferably, to enhance the white appearance of the lighting device in an OFF state, the light diffractive material within the light diffusing layer is a "nano-particle" having an average particle size of less than about 150 nm. For light sources that emit lights having other colors, the nano-particle may correspond to other average sizes. For example, the light diffractive material within the light diffusing layer for an UV light source may have an average particle size of less than about 100 nm.

Therefore, by appropriate selection of the average particle size of the light scattering material, it is possible to configure the light diffusing layer such that it scatters excitation light (e.g. blue light) more readily than other colors, namely green and red as emitted by the photoluminescence materials. For example, $TiO_2$ particles with an average particle size of 100 nm to 150 nm are more than twice as likely to scatter blue light (450 nm to 480 nm) than they will scatter green light (510 nm to 550 nm) or red light (630 nm to 740 nm). As another example, $TiO_2$ particles with an average particle size of 100 nm will scatter blue light nearly three times (2.9=0.97/0.33) more than it will scatter green or red light. For $TiO_2$ particles with an average particle size of 200 nm these will scatter blue light over twice (2.3=1.6/0.7) as much as they will scatter green or red light. In accordance with some embodiments of the invention, the light diffractive particle size is preferably selected such that the particles will scatter blue light relatively at least twice as much as light generated by the phosphor material(s).

Another problem with remote phosphor devices that can be addressed by embodiments of the invention is the variation in color of emitted light with emission angle. This problem is commonly called COA (Color Over Angle). Remote phosphor layers allow a certain amount of blue light to escape as the blue component of white light. This is directional light coming from the LEDs. The RGY (Red Green Yellow) light coming from the phosphor is lambertian. Therefore the directionality of the blue light may be different than that of the RGY light causing a "halo" effect at the edges with color looking "cooler" in the direction of the blue LED light and "warmer" at the edges where the light is all RGY. The addition of nano-diffuser selectively diffuses blue light—causing it to have the same lambertian pattern as the RGY light and creating a very uniform color over angle. Traditional LEDs also have this problem which can be improved by remote phosphor using this technology. Remote phosphor devices are often subject to perceptible non-uniformity in color when viewed from different angles. Embodiments of the invention correct for this problem, since the addition of a light diffusing layer in direct contact with the wavelength conversion layer significantly increases the uniformity of color of emitted light with emission angle θ.

Embodiments of the present invention can be used to reduce the amount of phosphor materials that is required to manufacture an LED lighting product, thereby reducing the cost of manufacturing such products given the relatively costly nature of the phosphor materials. In particular, the addition of a light diffusing layer composed of particles of a light diffractive material can substantially reduce the quantity of phosphor material required to generate a selected color of emitted light. This means that relatively less phosphor is required to manufacture a wavelength conversion component as compared to comparable prior art approaches. As a result, it will be much less costly to manufacture lighting apparatuses that employ such wavelength conversion components, particularly for remote phosphor lighting devices. In operation, the diffusing layer increases the probability that a photon will result in the generation of photoluminescence light by reflecting light back into the wavelength conversion layer. Therefore, inclusion of a diffusing layer with the wavelength conversion layer can reduce the quantity of phosphor material required to generate a given color emission product, e.g. by up to 40%.

Figure 16:
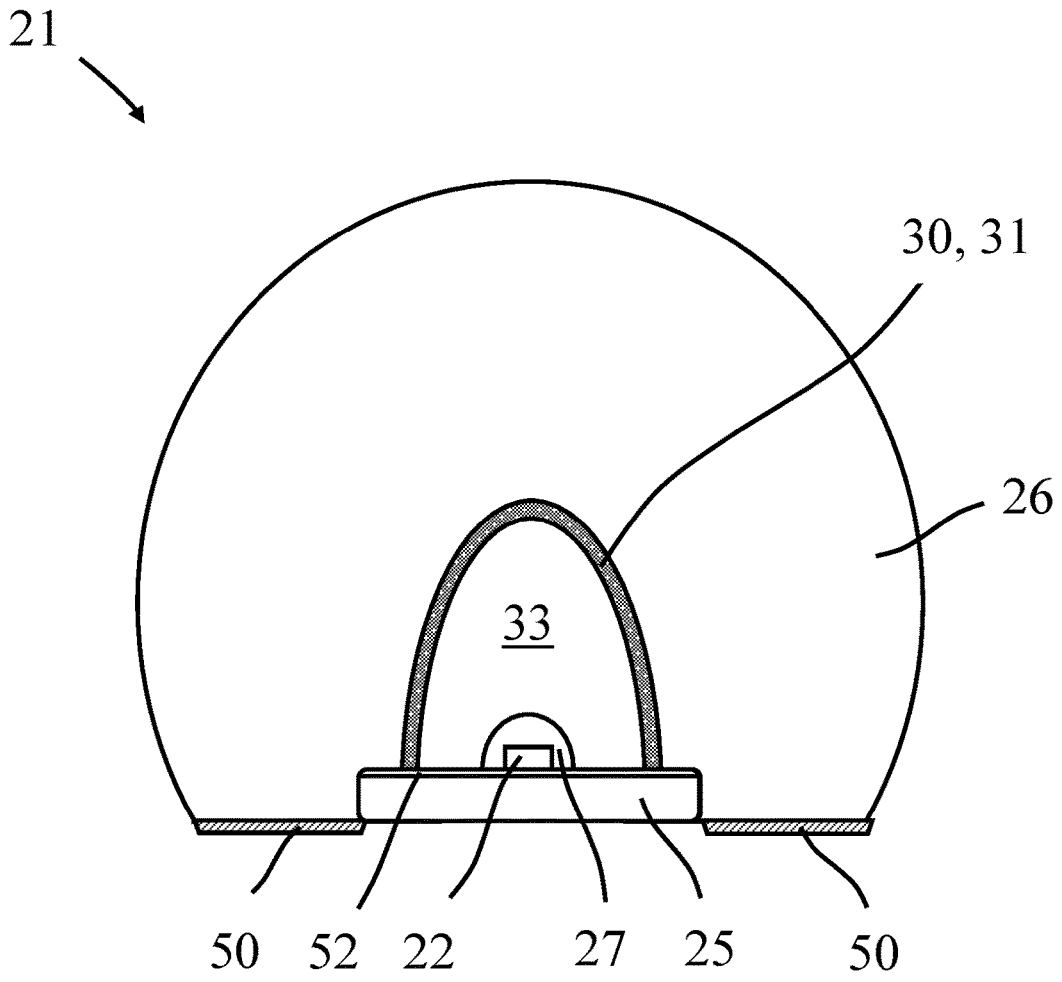
Figure 17:
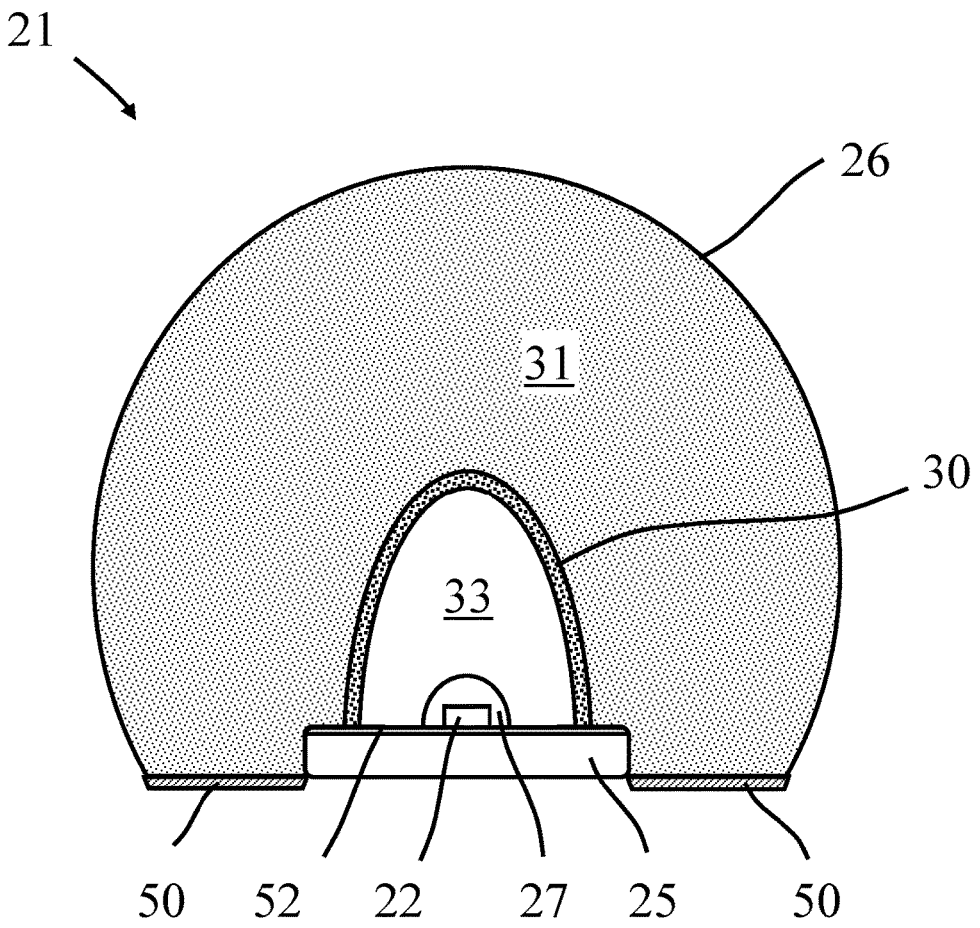

FIGS. 15, 16, and 17 illustrate different approaches to introduce light scattering materials into an LED lamp, which can substantially reduce the quantity of phosphor material required to generate a selected color of emitted light. In addition, the light diffusing layer can be used in combination with additional scattering (or reflective/diffractive) particles in the wavelength conversion component to further reduce the amount of phosphor material that is required to generate a selected color of emitted light. FIG. 15 illustrates an approach in which the light scattering material 31 is included within a separate layer. FIG. 16 illustrates an approach in which the light scattering material 31 is included within the layer containing the phosphor 30. FIG. 17 illustrates an alternative approach in which the light scattering material 31 is introduced into the lens 26. Any combination of the above may also be implemented. For example, the light scattering material 31 can be introduced into both the layer of phosphor 30 and the lens 26. In addition, the light scattering material can be included within both a separate layer 31 and the layer of phosphor 30. Moreover, the light scattering material 31 can be included within each of the separate layer, the layer of phosphor 30, and the lens 26.

Alternative approaches can be taken to improve the off-state white appearance of the lamp. For example, texturing can be incorporated into the exterior surface of the lamp to improve the off-state white appearance of the lamp, e.g. in the exterior surface of the lens 26.

Yet another possible approach is to implement a thin white layer directly after the yellow phosphor layer and before the clear linear optic. This three layer structure would be white appearance in the off-state but the primary optic would still be clear (not diffused/cloudy). This approach has the benefit of preserving the light distribution pattern of the linear lens optics while still providing white appearance.

Further details regarding an exemplary approach to implement scattering particles are described in U.S. patent application Ser. No. 11/185,550, filed on Oct. 13, 2011, entitled "Wavelength Conversion Component With Scattering Particles", which is hereby incorporated by reference in its entirety.

Figure 18:
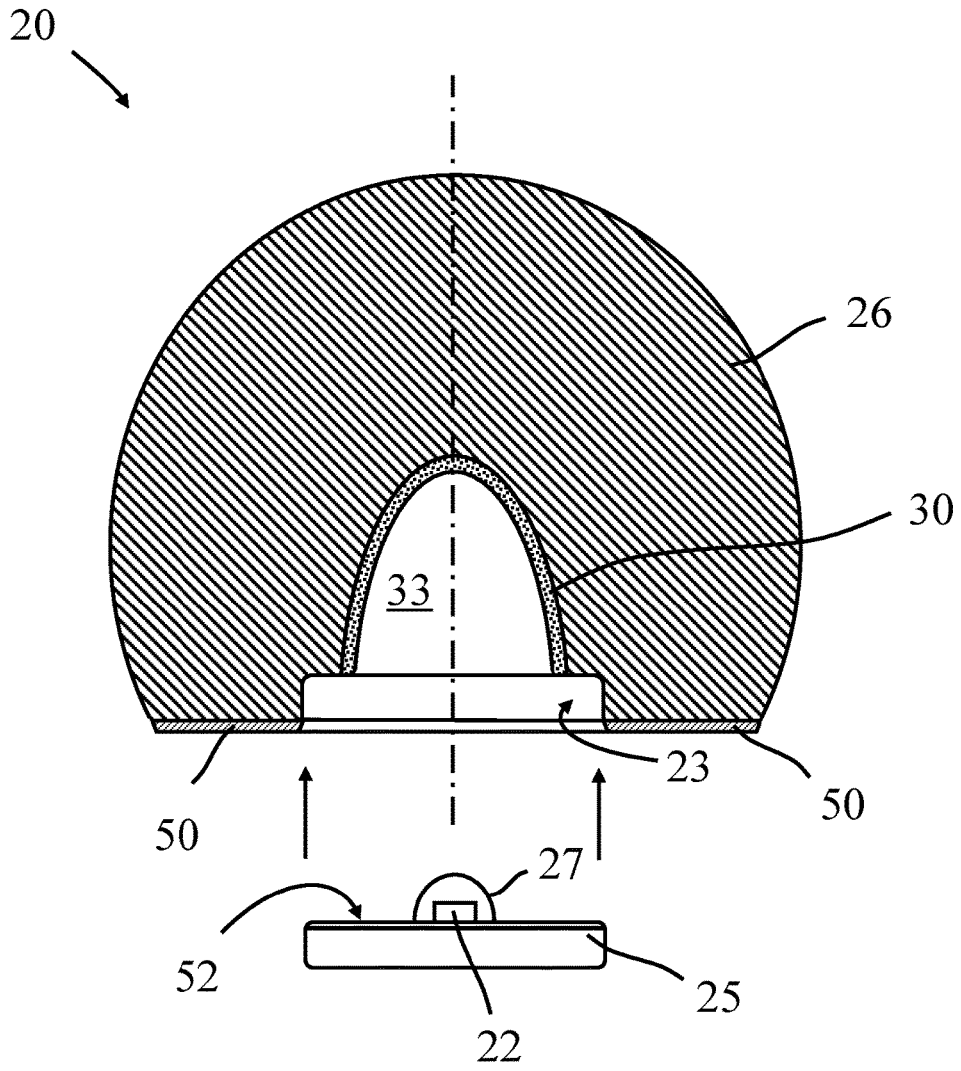
FIG. 18 is a schematic sectional representation of a LED lighting arrangement with an interior chamber.
Figure 19:
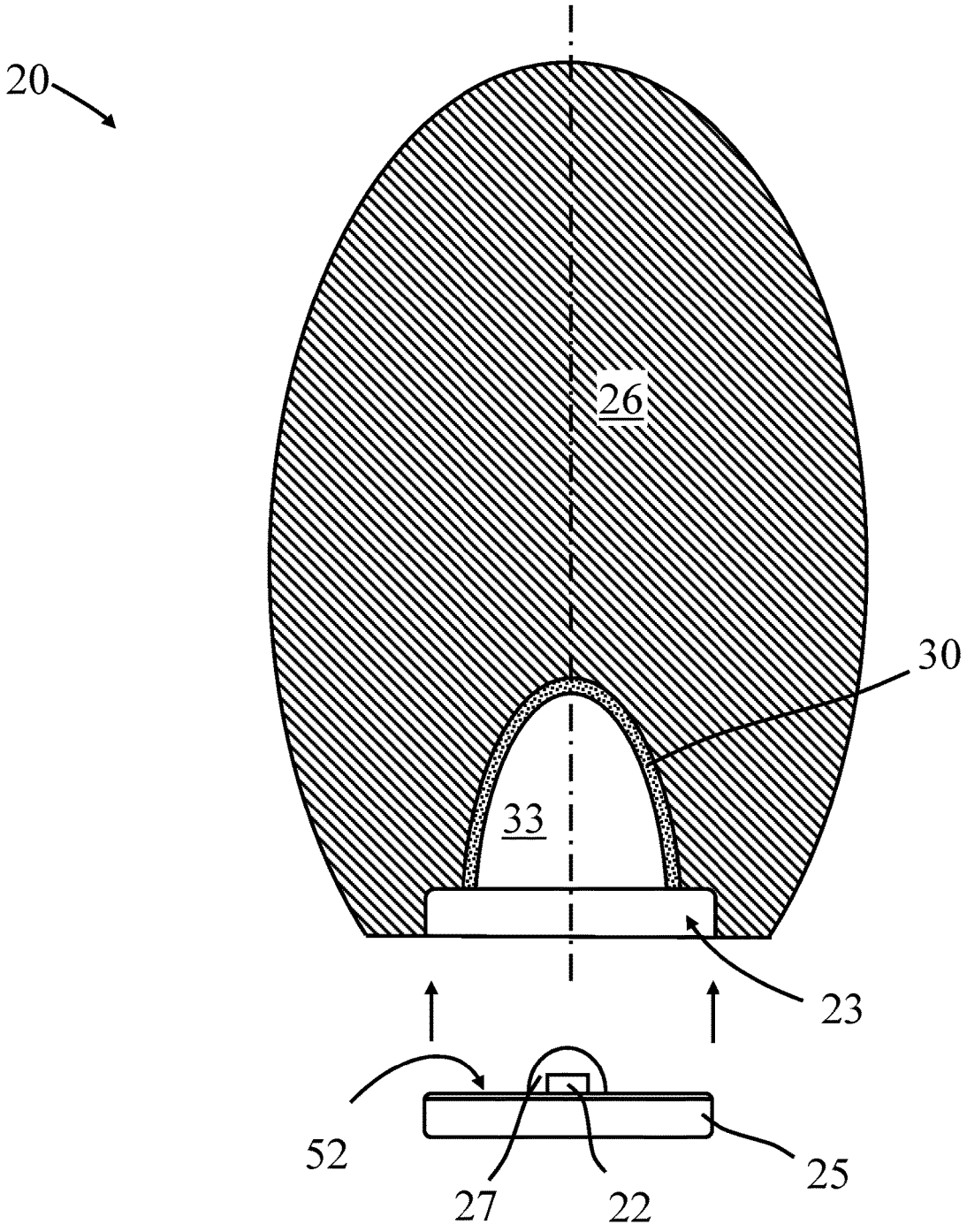
FIG. 19 is a schematic sectional representation of a LED lighting arrangement with an interior chamber and an ovoid lens shape.

The approach of using an interior cavity as a "mixing chamber" can be applied to non-linear lamps as well. FIG. 18 shows a LED lighting arrangement 20 in accordance with an embodiment of the invention where the lens 26 comprises a solid semi-spherical shape. The LED chip 22 is mounted within the chamber 33 of the lighting arrangement 20, such that it is wholly contained within the interior of the profile of the phosphor 30. An indentation 23 is formed within the lens 26 to receive the PCB 25.

Figure 20:
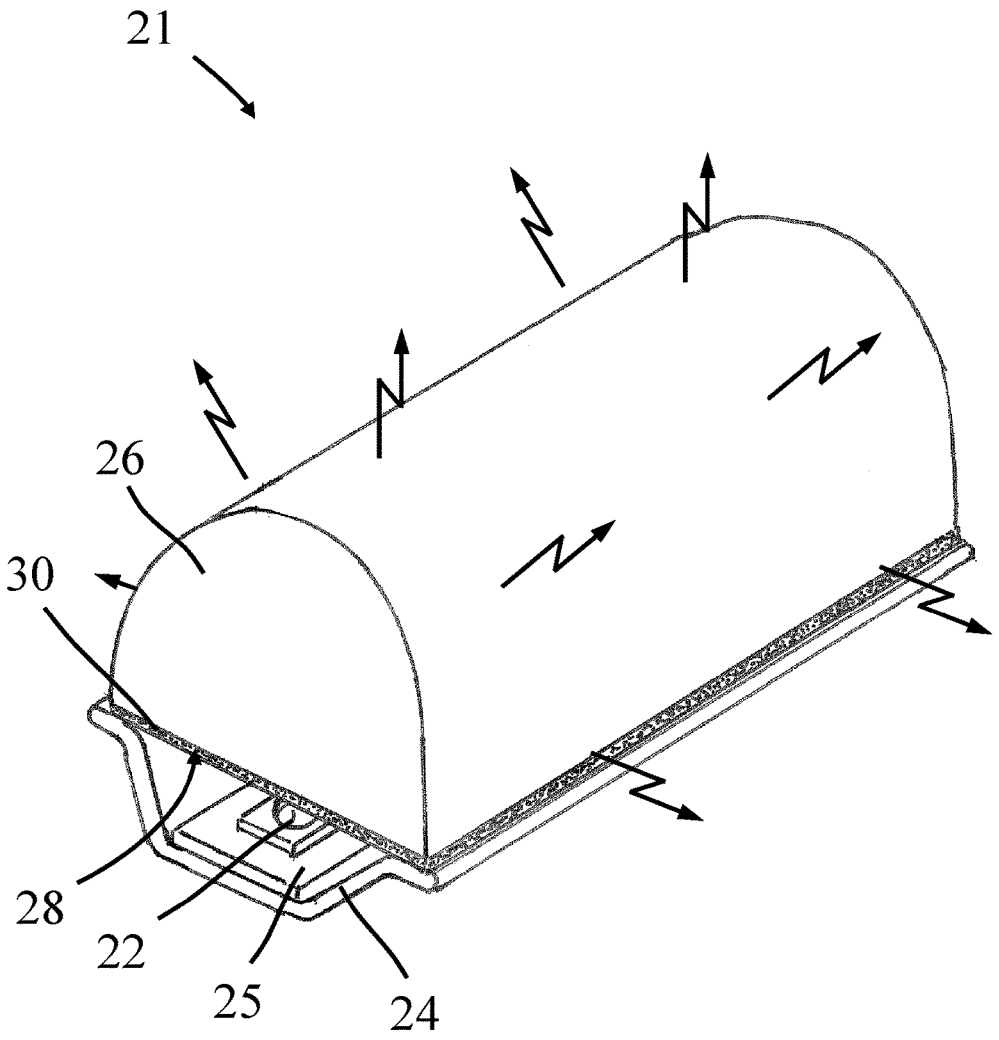
FIGS. 20-22 are schematic representations of alternate LED linear lamp lighting arrangements with scattering particles.

The lens 26 can be fabricated to provide any suitable shape as desired. For example, FIG. 20 shows an alternate LED lighting arrangement in accordance with an embodiment of the invention where the lens 26 comprises a solid ovoid shape. As before, the LED chip 22 is mounted within the chamber 33 of the lighting arrangement, such that it is wholly contained within the interior of the profile of the phosphor 30. An indentation 23 is formed within the lens 26 to receive the PCB 25.

Any of the embodiments described earlier can be configured as a linear lamp. For example, the embodiment of FIG. 2 shows a lamp having a convex lens 26 that is provided to focus light output from the arrangement, where the lens 26 is substantially hemispherical in form. The lens 26 has a planar, substantially flat, surface 28 onto which there is provided a layer of phosphor 30 before the lens is mounted to the enclosure 24. FIG. 20 illustrates a linear lamp with a cross-sectional profile having a similar structure. The linear lamp comprises an elongate lens 26 that is semi-circular in its cross-sectional shape, where the base of the lens 26 has a planar surface 28 onto which there is provided an elongate layer of phosphor 30. The LED 22 is mounted to a support surface where it is exterior to the lens 26.

Figure 21:
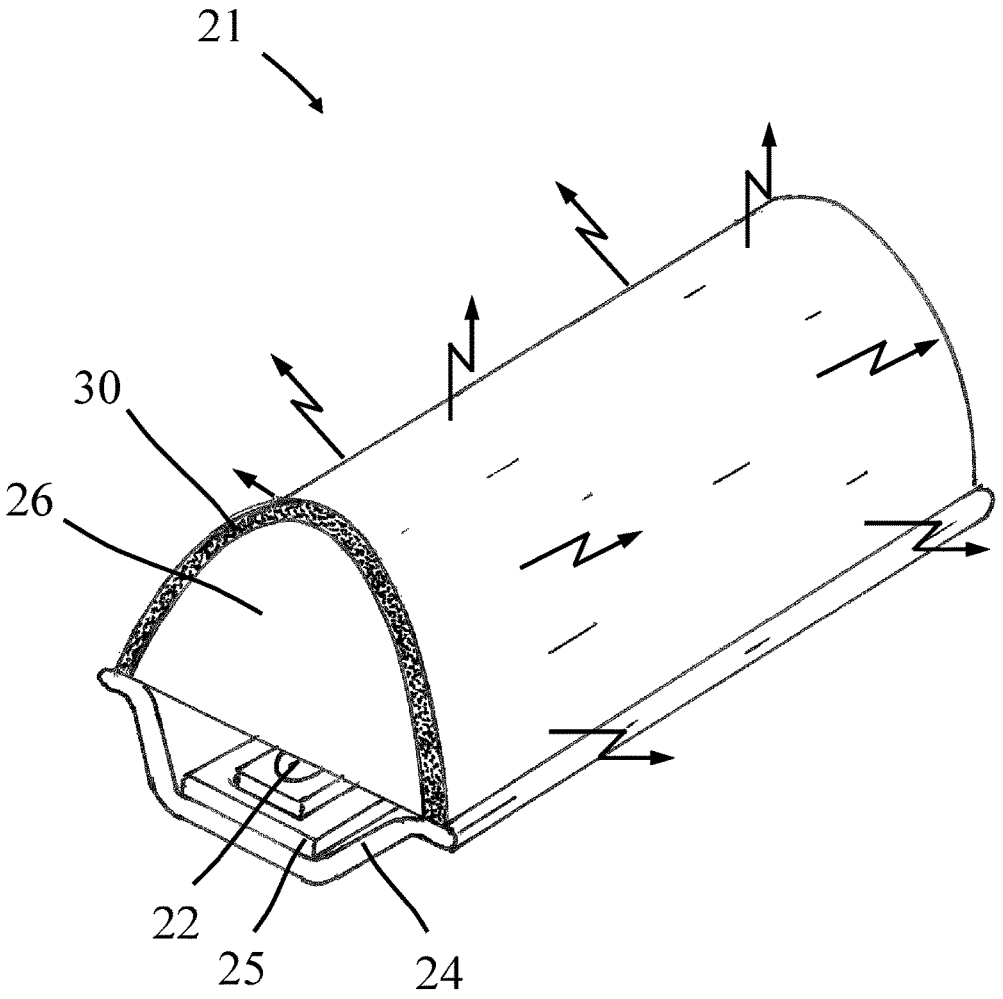

Similarly, the previously described embodiment of FIG. 3 is directed to an LED lighting arrangement in which the phosphor 30 is provided as a layer on the outer convex surface 32 of the lens 26. In this embodiment the lens 26 is dome shaped in form. FIG. 21 illustrates a linear lamp with a cross-sectional profile having a similar structure. The linear lamp comprises an elongate lens 26 that is semi-circular in its profile, where the phosphor 30 is provided as a layer on the outer surface of the lens 26.

Figure 22:
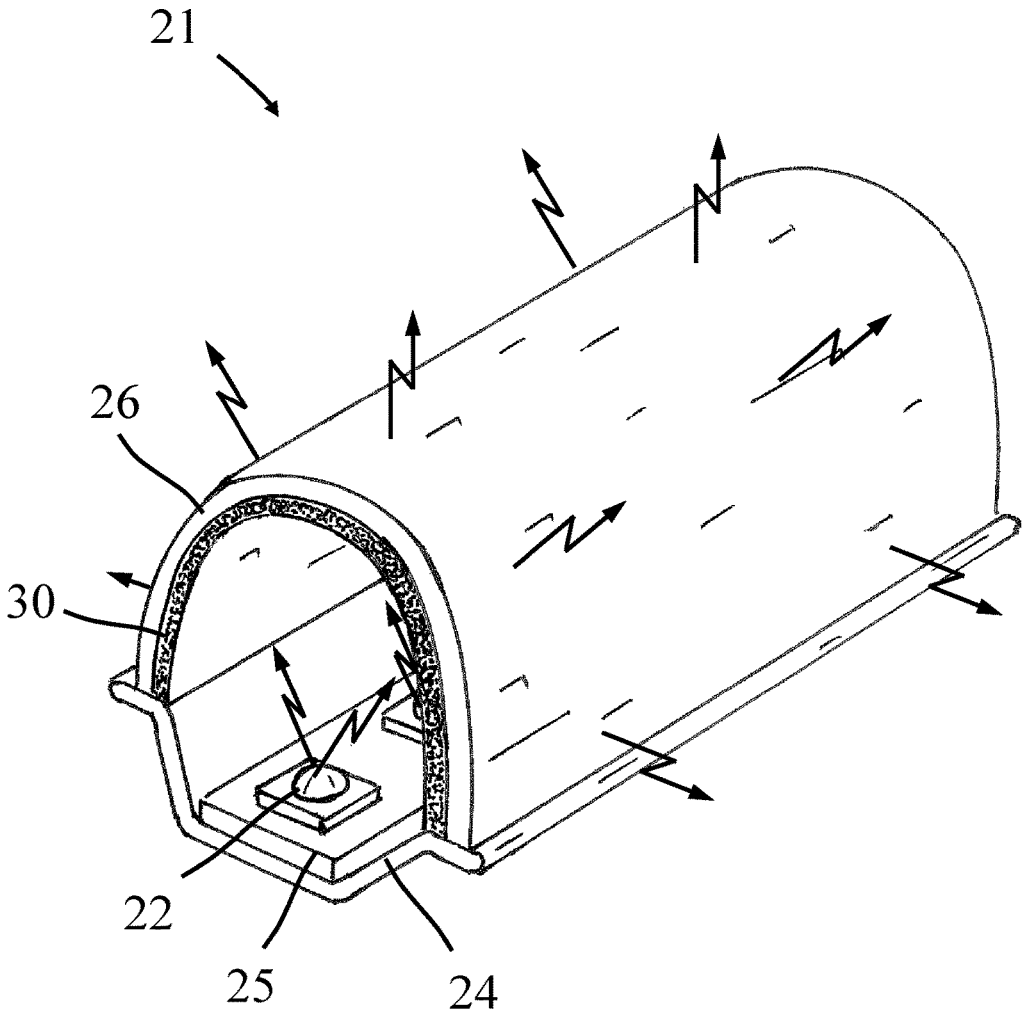

The previously described embodiment of FIG. 4 is directed to an LED lighting arrangement in which the lens 26 comprises a substantially hemispherical shell and the phosphor 30 is provided on either the inner or outer surface of the lens 26. FIG. 22 illustrates a linear lamp with a cross-sectional profile having a similar structure, in which the linear lamp comprises an elongate lens 26 having semi-circular shell profile, where the phosphor 30 is provided as a layer on the inner or outer surface of the lens 26.

Figure 23:
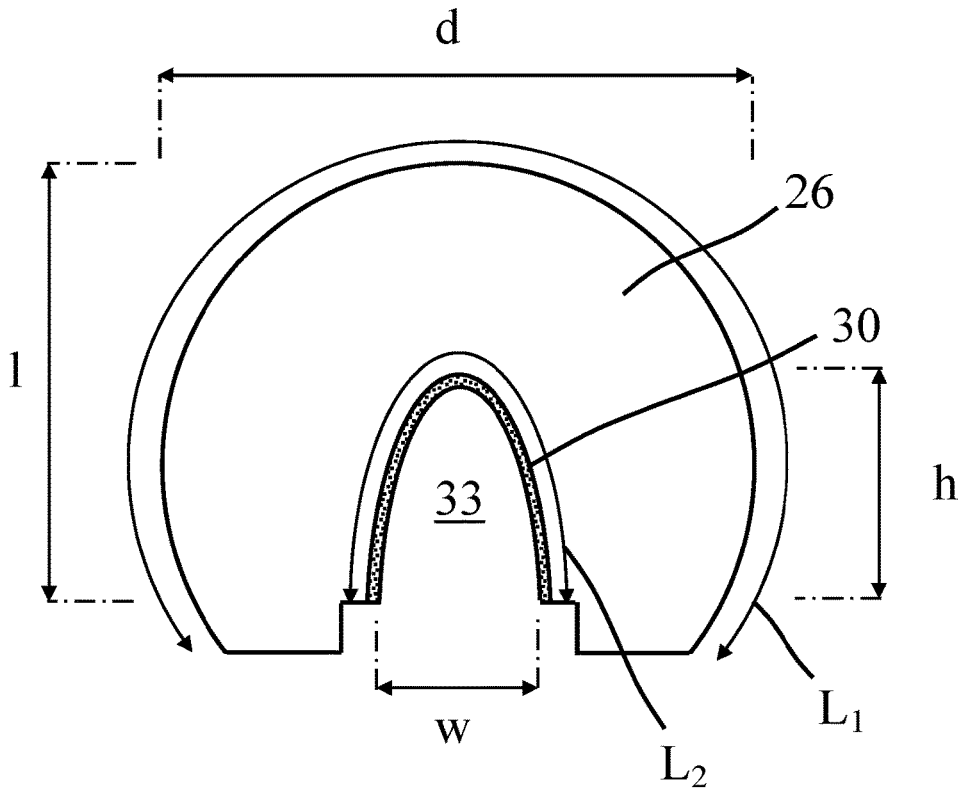
FIG. 23 is a schematic end view of a LED linear lamp component.

FIG. 23 illustrates an example configuration for the profile of a lamp according to some embodiments of the invention. The arrangement of this figure shows a phosphor portion 30 with a conical (or candle) sectional shape within the chamber 33. When implemented as a T8 replacement lamp, the overall diameter d=25.54 mm (1 inch), 1=20.70 mm, h=9.62 mm, and w=8 mm. The length $L_1$ for the exterior surface of the lens 26 exceeds the length $L_2$ of the surface of the phosphor portion 30. In some embodiments $L_2$ is at least two times $L_1$. The surface area of the phosphor material is 10.5 $in^2$/ft.

Figure 24:
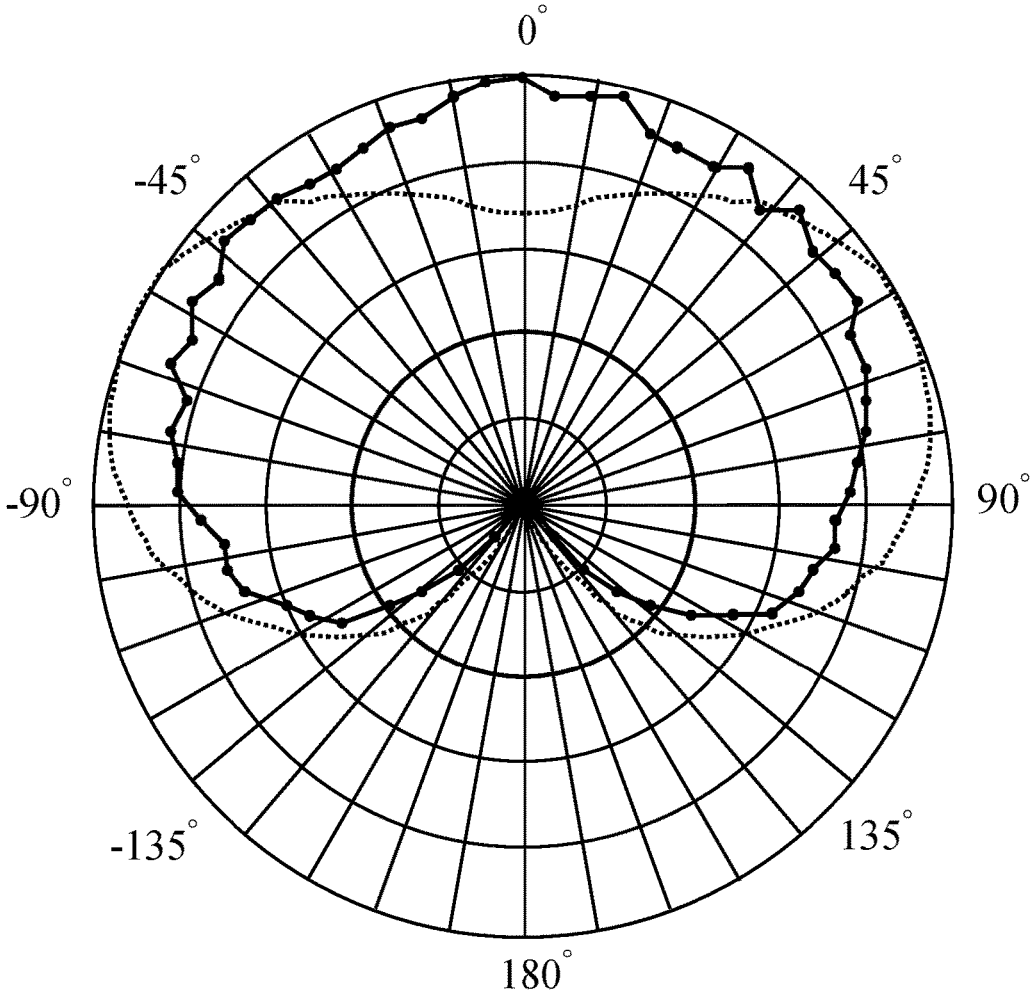
FIG. 24 is a diagram of emission patterns for an example lamp utilizing the component of FIG. 23.

FIG. 24 is a diagram showing the emission patterns for light distributed by one example implementation of the lamp of FIG. 23. The dotted line shows the emission pattern for an example lamp that does not include a lens 26. The solid line shows the emission pattern for an example lamp that does include a lens 26. It can be seen that the lens serves to shape the emitted light such that a greater concentration generally occur towards 0 degrees on the chart (towards the tip of the conical shape of the phosphor portion 30).

Figure 25:
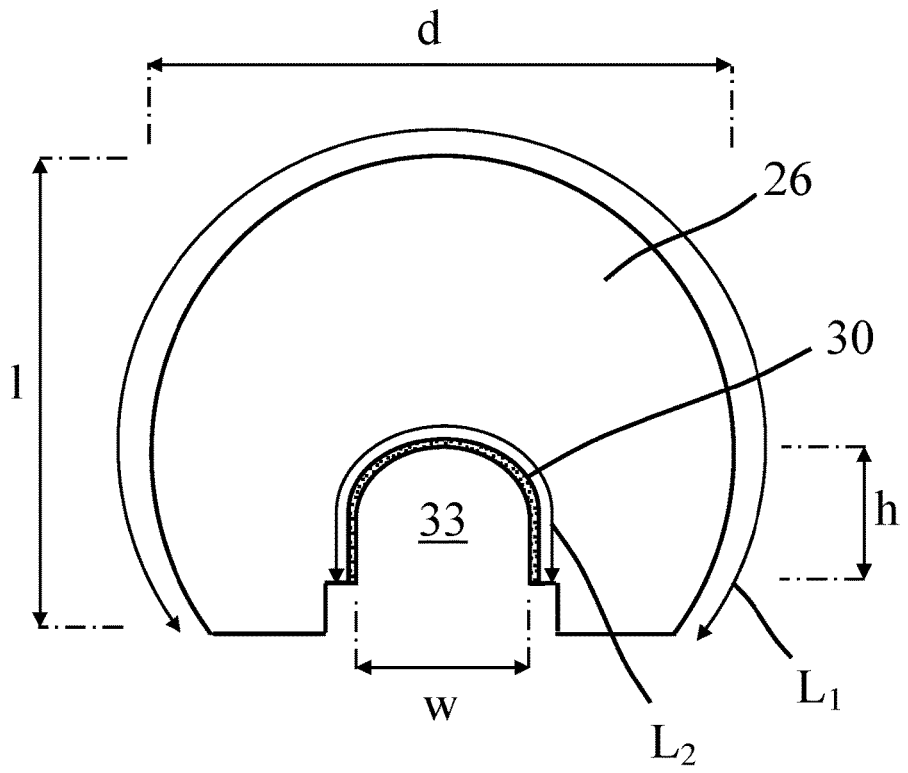
FIG. 25 is a schematic end view of a LED linear lamp component.

FIG. 25 illustrates another example configuration for the profile of a lamp according to some embodiments of the invention. The arrangement of this figure shows a phosphor portion 33 with a generally dome sectional shape within the chamber 33. When implemented as a T8 replacement lamp, the diameter d has a 1 inch (25.4 m) length and where l=20.70 mm, and w=8 mm, same as the embodiment of FIG. 23. However, the value of h in this embodiment is 6 mm. As before, the length $L_1$ for the exterior surface of the lens 26 significantly exceeds the length $L_2$ of the surface of the phosphor portion 30, e.g., where $L_2$ is at least two times $L_1$. The surface area of the phosphor material is 7.8 $in^2$/ft.

Figure 26:
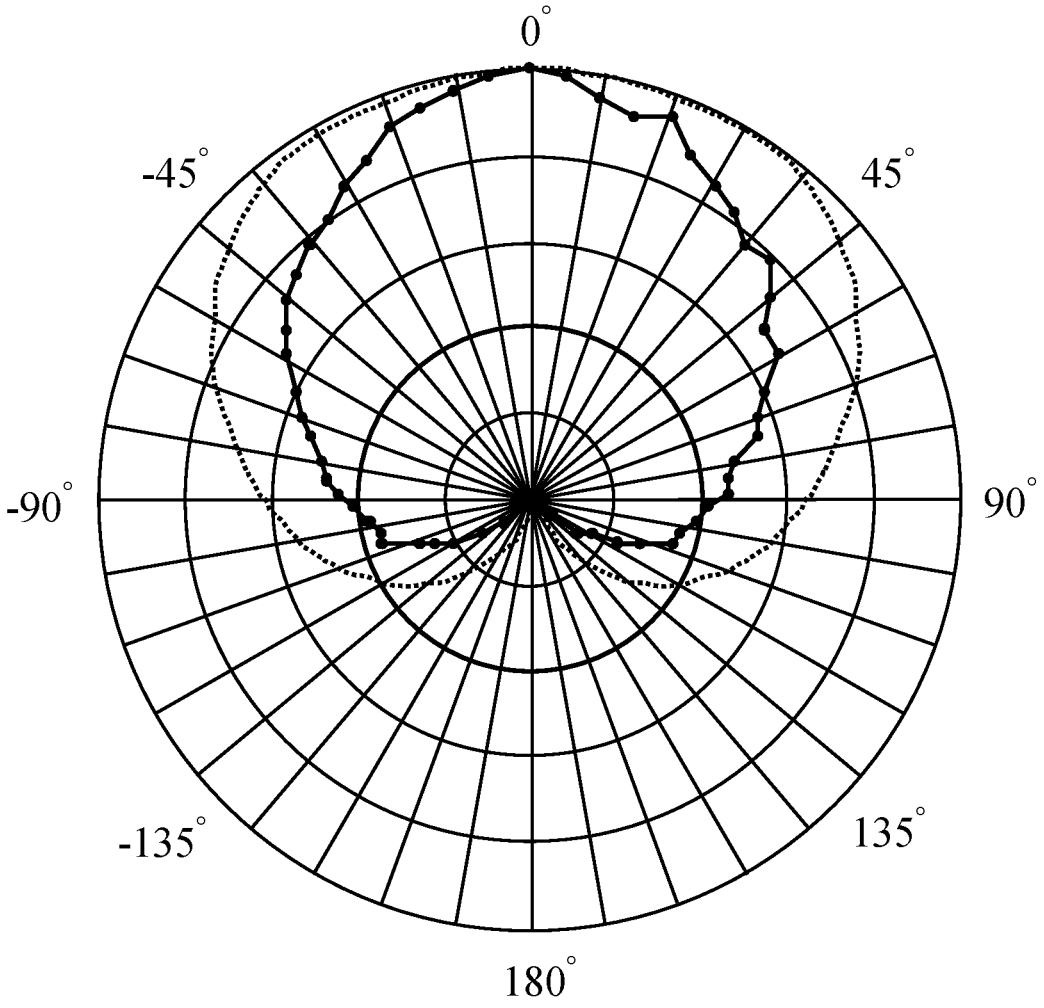
FIG. 26 is a diagram of emission patterns for an example lamp utilizing the component of FIG. 25.

FIG. 26 is a diagram showing the emission patterns for light distributed by one example implementation of the lamp of FIG. 25. The dotted line shows the emission pattern for an example lamp that does not include a lens 26. The solid line shows the emission pattern for an example lamp that does include a lens 26. As before, it can be seen that the lens serves to shape the emitted light such that a greater concentration generally occur towards 0 degrees on the chart (towards the tip of the dome shape of the phosphor portion 30).

These diagrams show a clear difference between the emission pattern of the lamp of FIG. 23 and the emission pattern for the lamp of FIG. 25. The approach of using the dome-shaped cross-sectional profile provides a more uniform pattern in the near field (at or near the tube surface) light distribution and better far field beam control. The conical sectional shape of FIG. 23 provides a greater distribution of light along the sides of the lamp. In contrast, the dome-shaped sectional profile of FIG. 25 provides a greater distribution of light towards the top of the lamp. This highlights the ability to shape the light produced by the lamp by configuring the shape of the sectional profile of the phosphor/chamber in the lens. The approach of using the dome-shaped cross-sectional profile generally corresponds to less phosphor surface area than the cone-shaped sectional profile, which potentially translates to a less costly lamp design.

The arrangement of the lamp can also be configured to improve its light producing efficiency (also referred to herein as "System Quantum Efficiency" or SQE) and to reduce SQE light loss, where system quantum efficiency can be defined as the ratio of the total number of photons produced by the system to the number of photons generated by the LED. Many white LEDs and LED arrays are typically constructed of blue LEDs encapsulated with a layer of silicone containing particles of a powdered phosphor material or covered using an optical component (optic) including the phosphor material. The system quantum efficiency (SQE) of the known white LED and LED arrays is negatively affected by the loss of the total light output of the lamp during conversion of the blue LED light to white light, where the majority of light loss is not due to the photoluminescence conversion process but rather due to absorption losses for light (both photoluminescence and LED light) that is emitted back into the LED(s). Due to the photoluminescence conversion process being isotropic, photoluminescence light will be emitted in all directions and hence up to about 50% will be generated in a direction back towards the LED(s) giving rise to re-absorption and loss of photoluminescence light by the LED(s).

Figure 28:
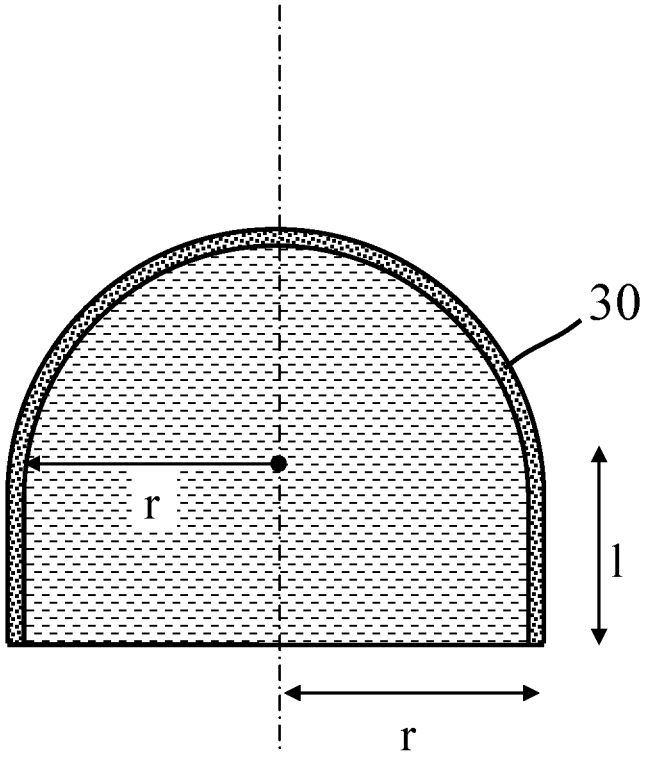
FIG. 28 is an end view LED linear lamp component in which a specific aspect ratio is provided.

By appropriately configuring the aspect ratio of the phosphor portion 30, it is possible to eliminate or significantly reduce the SQE losses of the lamp. The aspect ratio of the phosphor portion 30 is the ratio of the area of the phosphor layer to the area of the LED package. FIG. 28 is an example of such a component that comprises a cylindrical body of axial length l and radius r having a hemispherical end and a planar end which is mountable to an LED package. The phosphor is provided on the cylindrical and hemispherical surfaces of the component. In this exemplary embodiment the area of LED package (i.e. the planar base of the component) is $\pi r^2$ whilst the surface area of the wavelength conversion component (phosphor) is $2\pi r^2+2\pi rl$. As a result the aspect ratio is $2(r+l)/r:1$. For a component in which the length $l=0.5r$, that is a component whose length in an axial direction is one and a half times its diameter, the aspect ratio is preferably 3:1 (although other ratios may be employed in certain embodiments). For such a component the solid optic within chamber 33 transmits the majority of light to the opposite side of the phosphor optic and very little light returns to the LED and package base. Travelling through the solid optic has no refractive index changes so there is virtually 100% efficiency. Therefore the goal of this design is to maximize light emission by minimizing the amount of light returning to the LED package.

According to some embodiments of the invention, SQE loss is significantly eliminated or reduced by implementing the following combination of factors:

i) remote phosphor—the phosphor portion is separated from the LEDs;

ii) a coupling optic—An optical material having a high refractive index material is coupled directly to LEDs and the phosphor conversion component. This material should have a refractive index of 1.4 or greater (>1.5 preferred). Good optical coupling between the blue LEDs and the clear optic is used to ensure that it effectively acts as a light transport layer. By eliminating air interfaces and refractive index mismatches, virtually all light generated by the LEDs will travel with virtually no or minimal loss to the wavelength conversion component (phosphor layer).

iii) phosphor wavelength conversion layer with an aspect ratio greater than 1:1—the phosphor layer is separated from the blue LEDs by the clear coupling optic. Ideally the outer phosphor optic is the same refractive index as the clear layer and has no gap or other optical loss in the interface to the clear optic. The phosphor outer layer optic has an aspect ratio of 1:1 or greater such that the total surface area of the outer phosphor layer in contact with the clear coupling optic is at least three times the area of the LED package surface coupled to the clear coupling optic.

In operation blue light travels through the clear coupling optic with effectively no loss. When the blue light excites the phosphor layer and the photoluminescence light can now travel equally in any direction due to the elimination of the optical medium/air interface. Due to the high aspect ratio of the photoluminescence wavelength conversion component a majority of light (both phosphor generated light and scattered LED light) will not travel back to the LED package. Instead most light will travel through the clear optic to the other side and exit out of the phosphor layer on the opposing side. Once converted, YGR (Yellow, Green, Red) light easily passes through the phosphor layer. In summary, the majority of light is no longer re-cycled directly between the phosphor and the package/LEDs as it is in standard LED configurations.

With regard to linear lamp embodiments, any suitable manufacturing process may be employed to manufacture the lamp assembly. For example, a printing process can be employed where ink is printed using screen printing directly onto the lens surface. Other printing techniques can be used to print and/or coat the phosphor, such using roller coaters to coat the phosphor ink onto the lens. Spray coating is another technique that may be used to coat the phosphor onto the lens.

Lamination can also be performed to manufacture the linear lamp. In this approach, a separate sheet of phosphor material is manufactured, e.g. with or without a clear carrier layer. The sheet of phosphor is then laminated onto the light lens/pipe structure.

A co-extrusion process can be performed to manufacture a multi-layered linear lighting arrangement. Two extruders are used to feed into a single tool to create both the layer of phosphor and the materials of the lens. The two layers are simultaneously created and manufactured together in this approach. This approach can be used with a wide variety of source materials, e.g. PC-Polycarbonate, PMMA-Poly (methyl methacrylate), and PET-Polyethylene Terephthalate, including most or all thermoform plastics. This co-extrusion process can generally use pellets identical or similar to pellets used for injection molding materials. If the chamber in the lens includes a solid optical medium, then a co-extrusion approach can be used to manufacture the three layers with three extruders.

As noted above, a slot can be incorporated in the profile of the extrusion to accommodate the PCB or COB array. The use of an interior cavity approach makes for simple assembly and improved efficiency due to avoiding losses from an exterior mixing chamber. In some embodiments, the LEDs are mounted inside a linear mixing chamber and the extrusion is attached to the linear mixing chamber.

Figure 29:
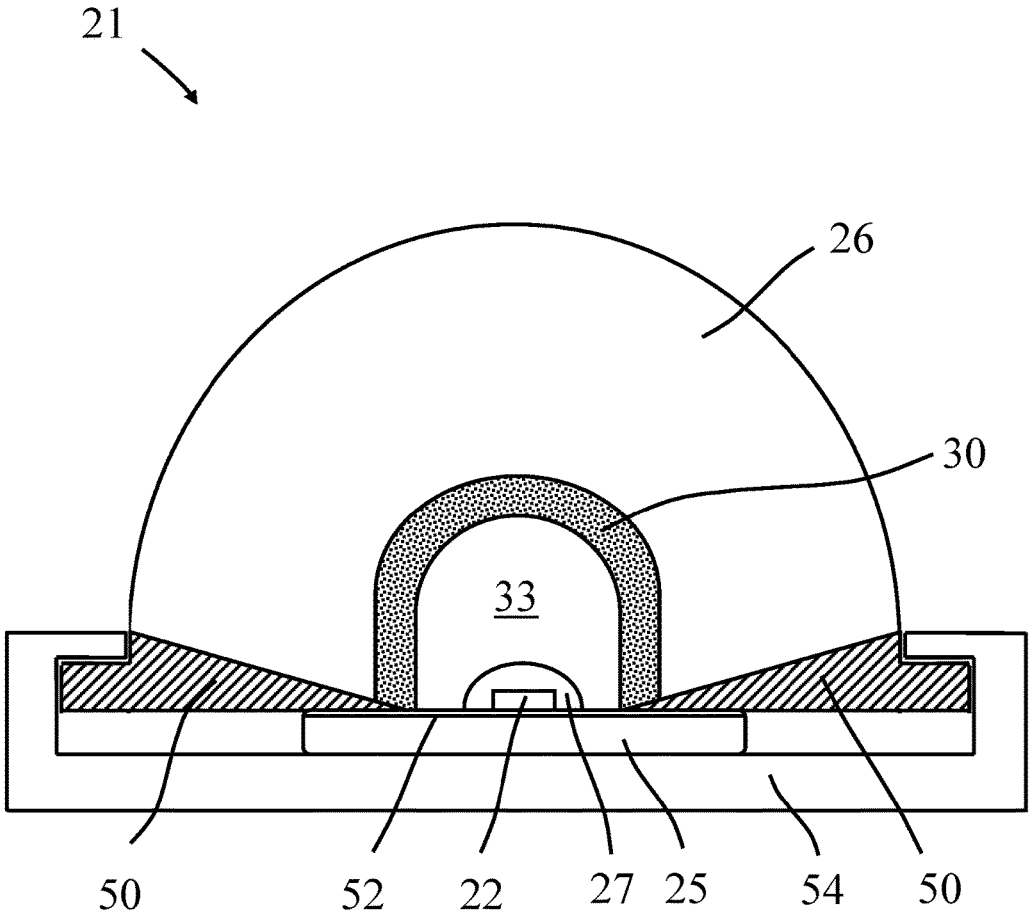
FIG. 29 illustrates the end view of a lamp having a multi-layered optic component according to some embodiments of the invention.

FIG. 29 illustrates the end view of another lamp according to some embodiments of the invention. The arrangement of this figure shows a multi-layered optic component, where the multi-layered optic component integrally includes a phosphor portion 30, a lens 26, and a reflector portion 50. As before, the phosphor portion 30 comprises a generally dome sectional shape that surrounds chamber 33. The lens 26 also comprises an exterior sectional profile having a dome shape. The reflector 50 is formed of any material that is capable of substantially reflecting light, and is intended to function by reflecting some or all of the phosphor-generated light from phosphor portion 30 away from the base of the lamp 21. In some embodiments, the reflector 50 comprises a white polycarbonate material.

A triple-extrusion process can be utilized to manufacture the multi-layered optic component, where three extruders are used to feed into a single tool to create the layer of phosphor, the materials of the lens, and the material of the reflector. Three extruders are used to feed into a single tool to create the three separate layers of materials, including phosphor, the materials of the lens, and the materials of the reflector. The three layers are simultaneously created and manufactured together in this approach. This approach can be used with a wide variety of source materials, e.g. PC-Polycarbonate, PMMA-Poly(methyl methacrylate), and PET-Polyethylene Terephthalate, including most or all thermoform plastics. This triple-extrusion process can generally use pellets identical or similar to pellets used for injection molding materials. If the chamber in the lens includes a solid optical medium, then a quadruple-extrusion approach can be used to manufacture the multiple layers with four extruders.

In some embodiments, the circuit board 25 having the array of LEDs 22 is mounted to, and in thermal communication with, a support body 54. The reflector 50 is formed having a lower flange portion that extends away from the central portion of the multi-layered optic component. The flange portion is configured to slot within a channel in support body 54. This allows the lamp 21 to be easily implemented by mounting support body 54 anywhere that a linear lamp is needed, and then attaching the multi-layered optic component to the support body by sliding the flange portion into the appropriate channels in the support body 54.

In alternate embodiments, the lamp is not manufactured by first mounting the LEDs 22 to the circuit board 25 that is attached to the support body 54. Instead, a co-extrusion process is utilized that manufactures the multi-layered optic component having the array of LEDs 22. In this embodiment, the LEDs 22 are attached to a flexible circuit board 25 that fed into the co-extrusion equipment, such that the multi-layered optic component is affixed to the circuit board having the LEDs as it is being formed.

Figure 30:
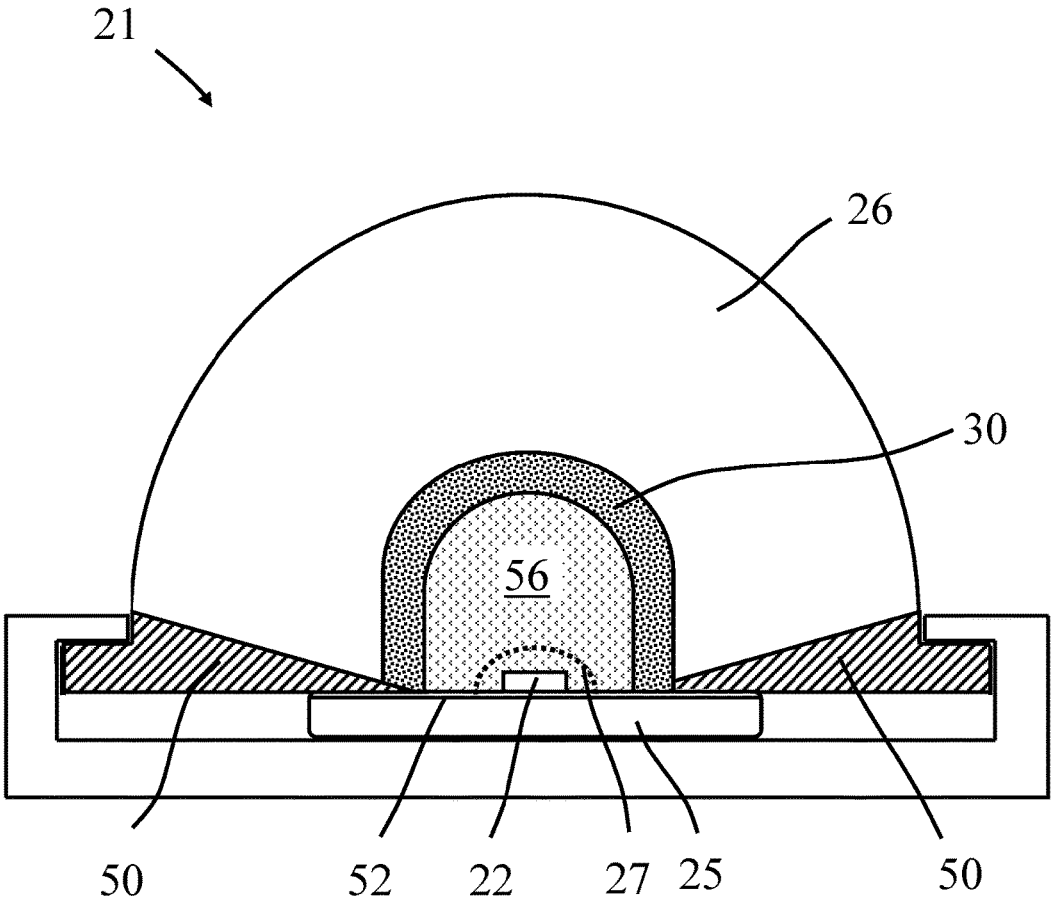
FIG. 30 illustrates the end view of a lamp having a multi-layered optic component, where an optical medium is placed within the chamber.

FIG. 30 illustrates an embodiment where the chamber is filled with an optical medium 56. The optical medium within the chamber 33 comprises a material, e.g., a solid material, possessing an index of refraction that more closely matches the index of refraction for the phosphor 30, the LEDs 22, and/or any type of encapsulating material 27 that may exist on top of the LEDs 22. As previously noted, one reason for using the optical medium 56 is to eliminate air interfaces that exist between the LEDs 22 and the phosphor 30. This reduces and/or eliminates any mismatches between the index of refraction of the material of the phosphor 30 and the index of refraction of the air within the interior volume 33 of the lamp 21. By reducing/preventing these mismatches in the indices of refraction, this removes the interfaces between air and the lamp components that may cause a significant portion of the light to be lost in the form of heat generation. By filling the chamber 33 with an optical medium 56, light is permitted to be emitted to, within, and/or through the interior volume of the lamp without having to incur losses caused by excessive mismatches in the indices of refraction for an air interface. The optical medium may be selected of any suitable material, e.g. silicone, to generally fall within or match the index of refraction for materials typically used for the phosphor 30, the LEDs 22, and/or any encapsulating material that be used to surround the LEDs 22.

If the chamber 33 in the lens includes a solid optical medium 56, then a co-extrusion approach can be used to manufacture the multi-layered optic component to also include the optical medium 56, e.g., by adding an extruder that for the material of the optical medium 56. If the optical medium 56 comprises a liquid material, then the liquid material can be injected or inserted into chamber 33 after the multi-layered optic component has been mounted onto the support body 54. If desired, a curing process (e.g., using UV light) can further be used to solidify the liquid material of the optical medium 56.

A light diffusing/scattering material can be used in conjunction with the multi-layered optic component. The light diffusing/scattering material is useful to reduce the quantity of phosphor material that is required to generate a selected color of emitted light. The light diffusing/scattering material is also useful to improve the off-state white appearance of the lamp 21.

Figure 31:
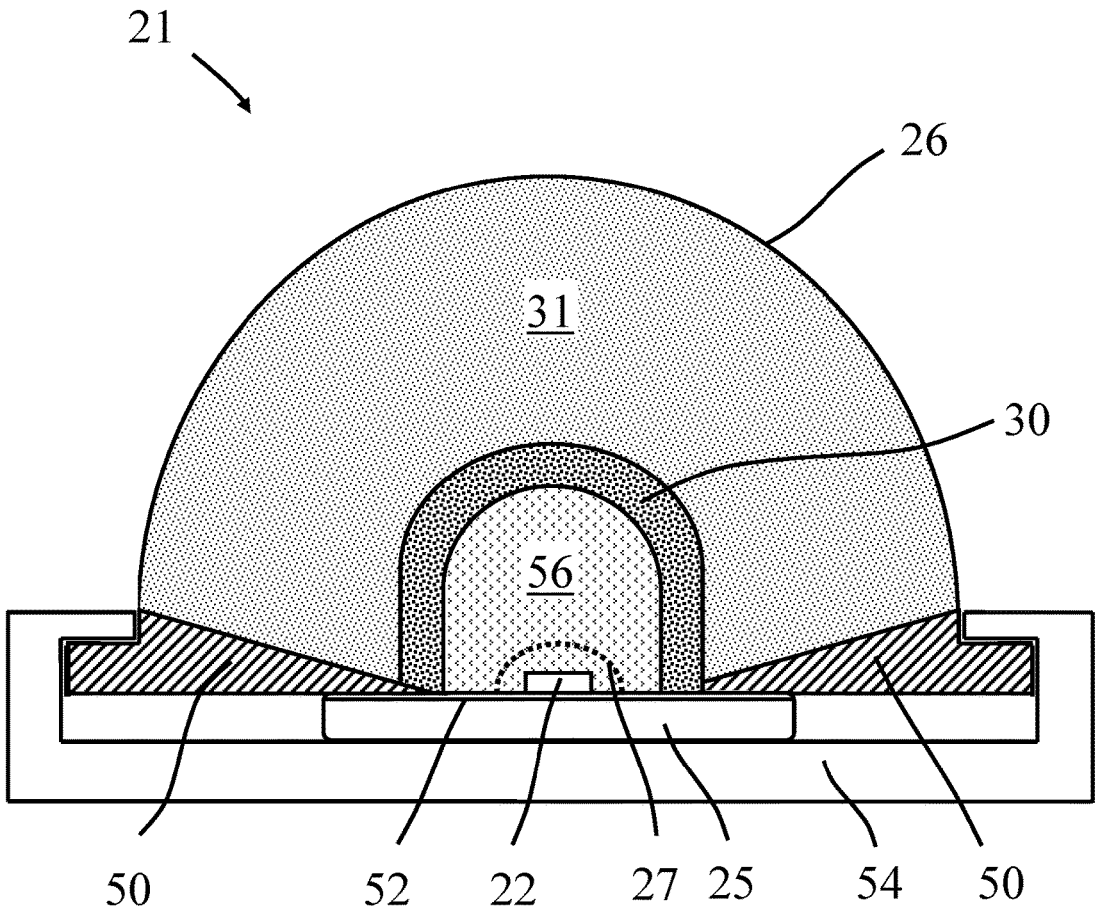
FIG. 31 illustrates the end view of a lamp having a multi-layered optic component, which further includes scattering particles.

The light diffusing/scattering material may be included into any of the layers of the multi-layered optic. For example, the light diffusing/scattering material can be incorporated into the layer containing the phosphor 30, added to the lens 26, included as an entirely separate layer, or any combination. FIG. 31 shows an embodiment in which the light diffusing/scattering material 31 has been incorporated into the material of the lens 26 in the multi-layered optic component.

Figure 32:
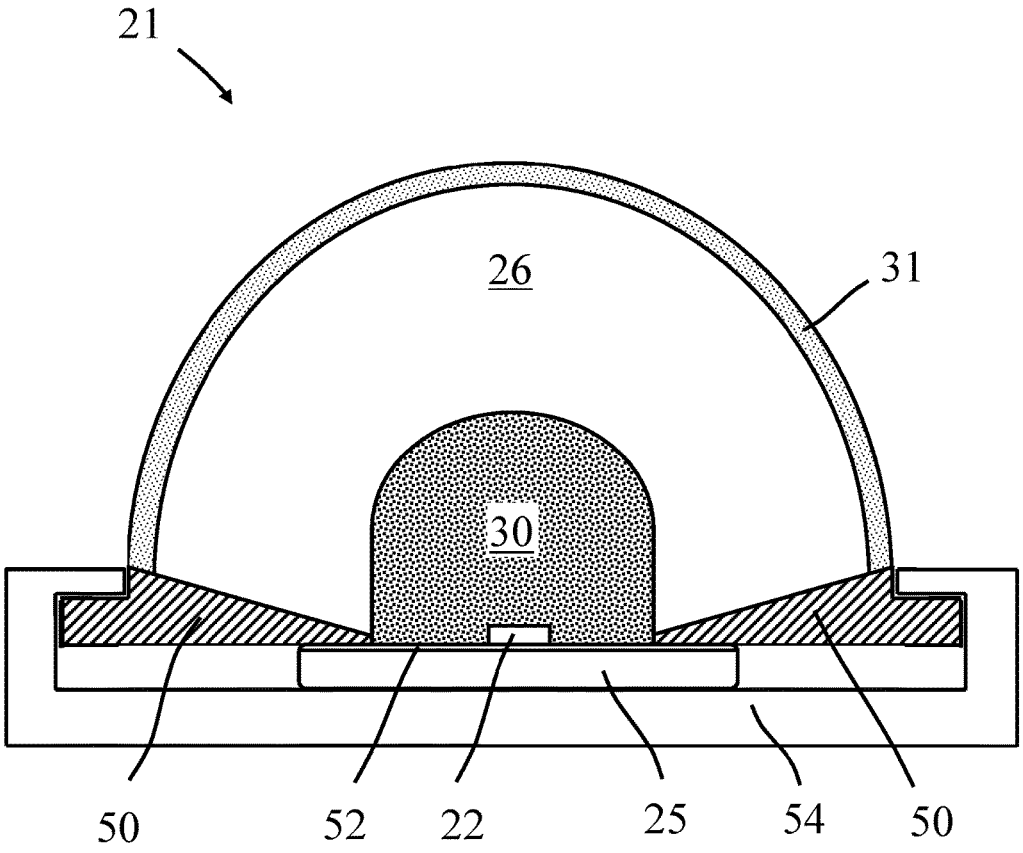
FIG. 32 illustrates the end view of a lamp having a multi-layered optic component, where an optical medium placed within the chamber comprises photoluminescent material.

In any of the disclosed embodiments, the combination of the solid optical medium 56 and the phosphor 30 can be replaced by a layer of material that entirely fills the volume surrounding the LED 22, but which also includes the phosphor integrally within that layer of material. This approach is illustrated in FIG. 32. Here, the lamp 21 does not have a thin separate layer of phosphor. Instead, the entirety of the interior volume that surrounds the LED 22 is filled with material that also includes the phosphor 30. This provides a hybrid remote-phosphor/non-remote-phosphor approach whereby the phosphor is located in the layer of material that fills the interior cavity, but some of the phosphor is located in close proximity to the LEDs 22 (in the inner portion of the material adjacent to the LED), but much of the phosphor is actually quite distant to the LEDs 22 (in the outer portion of the material away from the LED).

This approach therefore provides much of the advantages of remote-phosphor designs, while also maximizing light conversion efficiencies (due to elimination of mismatches in indices of refraction from eliminating air interfaces). Manufacturing may also be cheaper and easier, since the extrusion processes and apparatuses only need to extrude the single layer of materials, rather than an extruder for the phosphor material and a separate extruder for the optical medium material.

Figure 33:
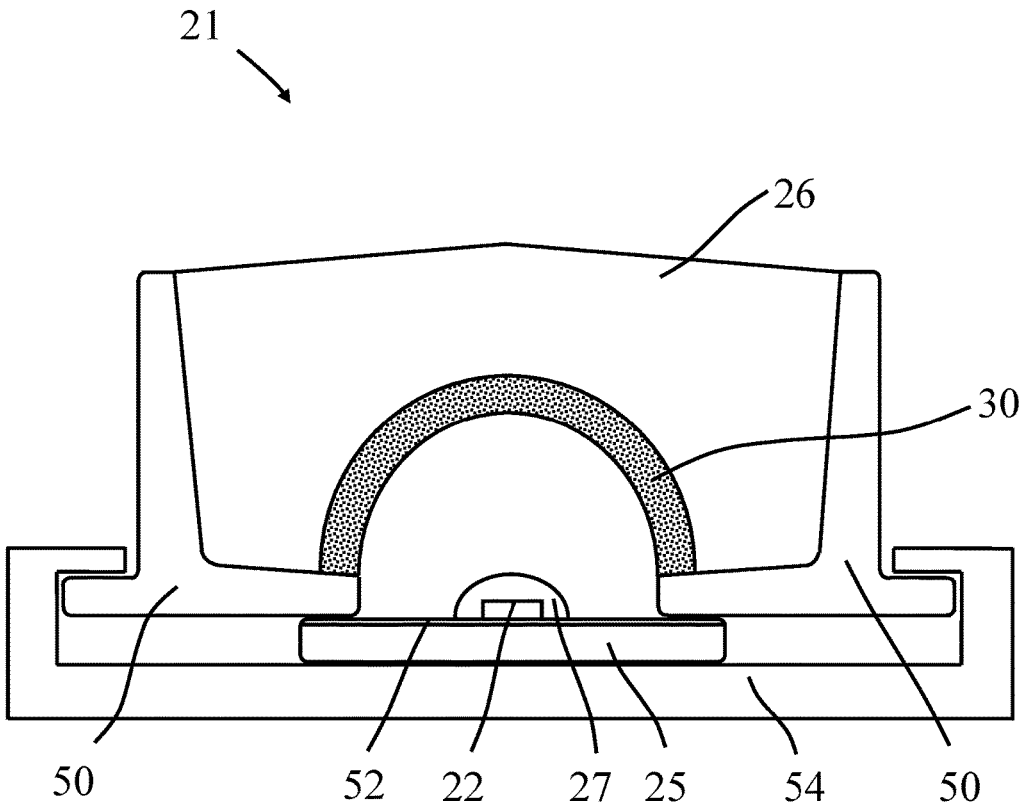
FIG. 33 illustrates the end view of a lamp having a multi-layered optic component, where the reflector comprises high walls.

FIG. 33 shows another embodiment in which the reflector 50 comprises high side walls. The side walls are useful to focus the light emitted form lamp 21 into a desired direction. The side walls of the reflector 50 can be configured, however, in any manner needed to generate a desired light emission pattern from the lamp 21.

Figure 34:
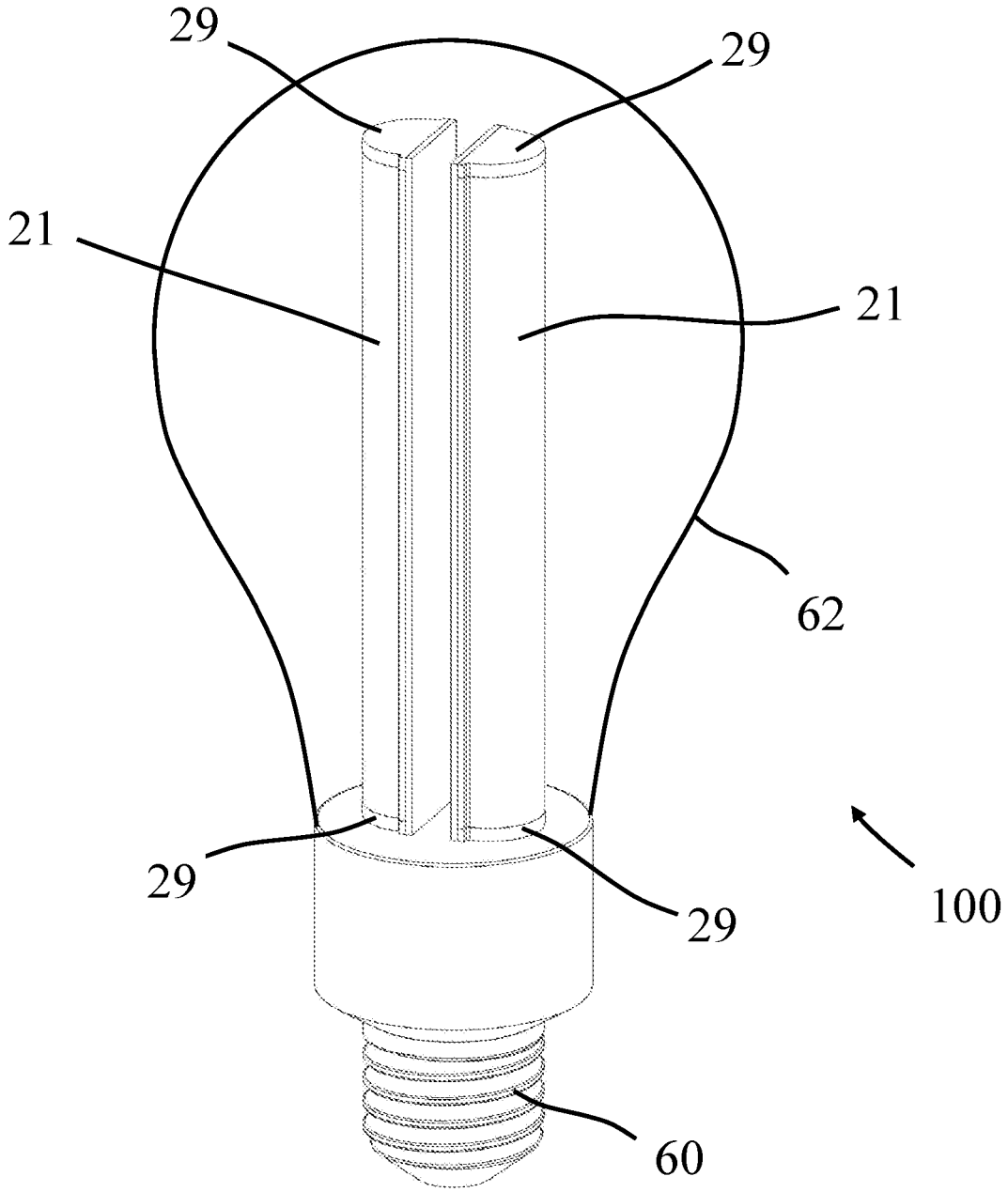
FIGS. 34 and 35 are perspective views LED lamps having vertically oriented linear light arrangements.

FIG. 34 illustrates an embodiment of a lamp 100 in which one or more linear lighting arrangements 21 are placed inside of an envelope 62 to form a replacement for a standard incandescent light bulb. As such, lamp 100 may include standard electrical connectors 60 (e.g., standard Edison-type connectors) that allow lamp 100 to be used in conventional lighting devices.

The linear lighting arrangements 21 function as the lighting elements in the lamp 100. The linear lighting arrangements 21 are vertically oriented, extending axially within the lamp 100, with end caps 29 placed at the end (e.g., distal end) of the linear lighting arrangements 21. Internally, the LEDs within the linear lighting arrangements 21 are oriented radially from the central axis of lamp 100. This configuration provides a good overall emission pattern from lamp 100 over a wide range of emission angles, with the exact dimensions (e.g., length, width) of the linear lighting arrangements 21 selected to provide a desired emission profile.

The envelope 62 may be configured in any suitable shape. In some embodiments, envelope 62 comprises a standard light-bulb shape. This permits the lamp 100 to be used in any application/location that could otherwise be implemented with a standard incandescent light bulb. The envelope 62 may include or be used in conjunction with a diffuser. In some embodiments, scattering particles are provided at the envelope 62, either as an additional layer of material or directly incorporated within the material of envelope 62.

Figure 35:
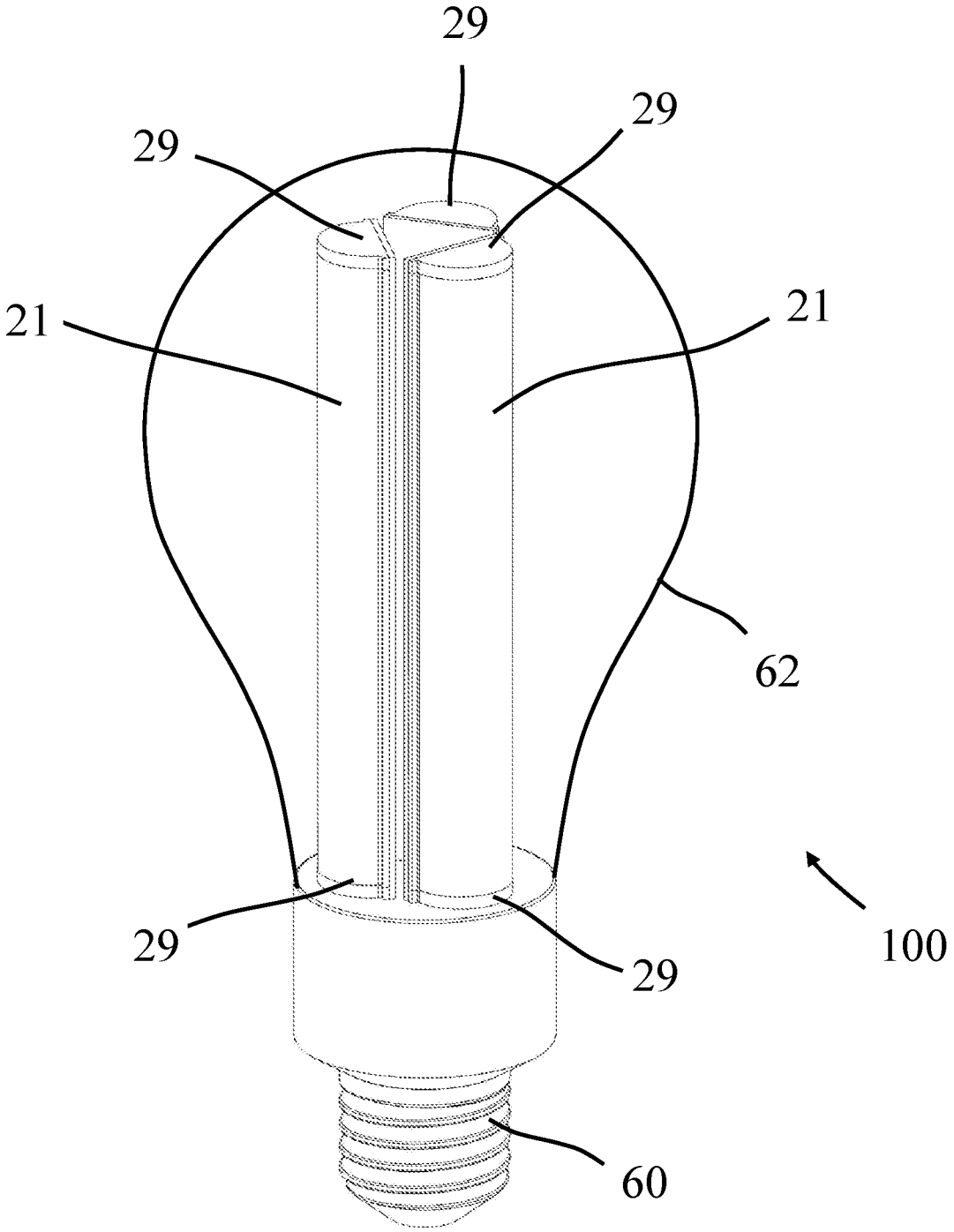

Any number of linear lighting arrangements 21 may be included in the lamp 100. Two linear lighting arrangements 21 are shown in the embodiment of FIG. 34. FIG. 35 illustrates an embodiment where three linear lighting arrangements 21 are arranged within the lamp 100. The exact number of linear lighting arrangements 21 to be placed into lamp 100 is selected to provide achieve desired performance characteristics. Examples of further LED bulbs implemented using linear lighting arrangements are disclosed in co-pending U.S. patent application Ser. No. 29/443,392, filed Jan. 16, 2013, entitled "LED Light bulbs", which is hereby incorporated by reference in its entirety.

Inline testing may be employed using any of the above approaches to control and minimize variations in the final manufactured product. The approach of U.S. application Ser. No. 13/273,201, filed Oct. 13, 2011 describes an approach for implementing in-line process controls to minimize perceptible variation in the amount of photo-luminescent material that is deposited in the wavelength conversion components. The approach described in this co-pending application can be used in conjunction with embodiments of the present invention, and is hereby incorporated by reference in its entirety.

With a co-extrusion system, one possible approach to perform in-line testing is to mount a colorimeter or spectrometer that actively measures the product color while it was being extruded. This measurement tool would generally be mounted inline after the cooling bath and dryer but prior to cutting. The color measurement provides real-time feedback to the extrusion system which adjusts layer thickness by varying the relative pressures of the two extrusion screws. The phosphor layer is manufactured to be either thicker or thinner to tune the color of the product in real-time while the extrusion is taking place. This allows one to have single bin accuracy while being able to perform quality checks in real-time during the extrusion process. Similar inline testing could be used with printing and coating methods.

It will be appreciated that the present invention is not restricted to the specific embodiments described and that modifications can be made which are within the scope of the invention. For example although in the foregoing description reference is made to a lens the phosphor can be deposited onto other optical components such as for example a window through which light passes though is not necessarily focused or directed or a waveguide which guides, directs, light. Moreover the optical component can have many forms which will be readily apparent to those skilled in the art.

What is claimed is:

1. A lamp comprising:

a component comprising an elongate optical component that comprises an elongate interior cavity and a layer of photoluminescent material that is on an interior wall of the elongate interior cavity and an array of solid-state light emitters configured to emit light into the elongate interior cavity;

wherein the elongate optical component and the layer of photoluminescent material are simultaneously created and manufactured together by co-extrusion to form a co-extruded structure having the elongate interior cavity.

2. The lamp of claim 1, wherein the elongate optical component corresponds to a curved exterior wall.

3. The lamp of claim 2, wherein the curved exterior wall comprises a generally semicircular cross-sectional profile.

4. The lamp of claim 1, wherein the interior wall of the elongate interior cavity corresponds to generally curved interior wall.

5. The lamp of claim 4, wherein the layer of the photoluminescent material comprises a generally conical, semicircular or dome-shaped cross-sectional profile.

6. The lamp of claim 1, wherein the component comprises a slot for receiving a circuit board having the array of solid-state light emitters.

7. The lamp of claim 1, further comprising a diffusing material, and wherein the elongate optical component, the layer of photoluminescent material and the diffusing material are simultaneously created and manufactured together by co-extrusion to form the co-extruded structure having the elongate interior cavity.

8. The lamp of claim 7, wherein the diffusing material comprises an exterior layer of material on the elongate optical component.

9. The lamp of claim 7, wherein the diffusing material is incorporated within the optical component and/or the layer of the photoluminescent material.

10. The lamp of claim 1, further comprising a reflector comprising a reflective surface to reflect light emitted through the elongate optical component, wherein the elongate optical component, the layer of photoluminescent material and the reflector are simultaneously created and manufactured together by co-extrusion to form the co-extruded structure having the elongate interior cavity.

11. The lamp of claim 10, wherein the reflector extends away from a central portion of the component.

12. The lamp of claim 1, further comprising an optical medium within the elongate interior cavity, and wherein the elongate optical component, the layer of photoluminescent material and the optical medium are simultaneously created and manufactured together by co-extrusion to form the co-extruded structure having the elongate interior cavity.

13. The lamp of claim 1, wherein the elongate optical component is a lens.

14. The lamp of claim 1, wherein the co-extruded structure is affixed to the array of solid-state light emitters during extrusion.

15. The lamp of claim 1, wherein a wavelength conversion layer and/or an optical component layer comprise at least one of PC-Polycarbonate, PMMA-Poly(methyl methacrylate), PET-Polyethylene Terephthalate, and thermoform plastics.

16. The lamp of claim 1, wherein an exterior length of the elongate optical component is at least two times the length of the layer of photoluminescent material.

* * * * *